US005473990A

United States Patent [19]

Anderson et al.

[11] Patent Number: 5,473,990

[45] Date of Patent: Dec. 12, 1995

[54] RIDE VEHICLE CONTROL SYSTEM

[75] Inventors: Jeffrey G. Anderson, Saugus; William L. Wolf, North Hollywood, both of Calif.

[73] Assignee: The Walt Disney Company, Burbank, Calif.

[21] Appl. No.: 109,172

[22] Filed: Aug. 19, 1993

[51] Int. Cl.[6] ..... A63G 31/02

[52] U.S. Cl. ..... 104/85; 104/53; 104/154; 472/43; 472/59; 472/64; 180/165

[58] Field of Search ..... 104/53, 83, 85, 104/154, 289, 296; 434/37, 35, 58; 472/43, 57, 59, 64, 135; 180/165

[56] References Cited

U.S. PATENT DOCUMENTS

| | | | |
|---|---|---|---|
| Re. 15,244 | 12/1921 | Maynes . | |
| D. 254,622 | 4/1980 | Trussler | D19/63 |
| 373,439 | 11/1887 | Campbell . | |
| 491,572 | 2/1893 | Libbey . | |
| 717,457 | 12/1902 | Schofield . | |
| 773,613 | 11/1904 | Walsh . | |
| 784,345 | 3/1905 | Pepper . | |
| 788,886 | 5/1905 | Citron . | |
| 794,511 | 7/1905 | Knapp . | |
| 858,624 | 7/1907 | Reckweg . | |
| 859,604 | 7/1907 | Jossenberger . | |
| 871,643 | 11/1907 | Shaw . | |
| 879,615 | 2/1908 | Enochs . | |
| 887,505 | 5/1908 | Nelson et al. . | |
| 909,500 | 1/1909 | Woerth . | |
| 1,238,151 | 8/1917 | Keefe . | |
| 1,311,703 | 7/1919 | Meyer . | |
| 1,352,969 | 9/1920 | Kalix . | |
| 1,571,434 | 2/1926 | Ray . | |
| 1,590,934 | 6/1926 | Feltner . | |
| 1,712,353 | 5/1929 | Meling . | |
| 1,890,137 | 12/1932 | Traver . | |
| 2,058,279 | 10/1936 | Watkins | 104/53 |

(List continued on next page.)

FOREIGN PATENT DOCUMENTS

| | | |
|---|---|---|
| 455464 | 3/1949 | Canada . |
| 1343788 | 10/1963 | France . |
| 180079 | 6/1922 | United Kingdom . |

OTHER PUBLICATIONS

Doran Precision Systems, Inc., (1) "From Roller–Coasters To Road Races . . . With SR2, You'd Swear You're Really There!", (2) SR2 Specifications, (3) Doran Simulator Hydraulic Motion Systems Operational Specifications, (4) Photos of Motion Base and SR2.

*Primary Examiner*—Robert J. Oberleitner
*Assistant Examiner*—S. Joseph Morano
*Attorney, Agent, or Firm*—Pretty, Schroeder, Brueggemann & Clark

[57] ABSTRACT

This disclosure provides to a ride vehicle for used in an amusement attraction. The ride vehicle mounts a structure upon a hydraulically-actuated motion base, so that the passenger holding structure may be articulated about one or more axes as the vehicle moves. Thus, this "simulator ride" carries passengers through three-dimensional scenery and articulates the passenger holding structure in synchronism with motions of the ride vehicle, the motions of moving show sets, which are external to the vehicle, sound, projection and other effects. The ride vehicle is programmably-controlled, and derives electrical power from a track mounted power bus to drive vehicle hydraulics, which drive motion base actuation, steering and vehicle velocity.

The hydraulic control system uses an electric pump to charge a high-pressure accumulator with hydraulic power from a 480-volt power supply, a manifold to regulate the supply of hydraulic energy to motion base and steering actuators and a hydraulic motor, and a low-pressure accumulator that aids in regenerative braking. Using these elements, the computerized vehicle-control system controls the hydraulically-actuated elements to provide synchronized motions of the vehicle and passenger holding structure, and other special effects, in accordance with a selected one of a plurality of ride programs.

37 Claims, 22 Drawing Sheets

U.S. PATENT DOCUMENTS

| | | | |
|---|---|---|---|
| 2,135,230 | 11/1938 | Courtney | 104/76 |
| 2,137,839 | 11/1938 | Hanna | 104/75 |
| 2,196,093 | 4/1940 | Bartlett | 104/53 |
| 2,461,780 | 2/1949 | Smith et al. | 119/15.5 |
| 2,685,003 | 7/1954 | Barnes et al. | 191/48 |
| 2,718,194 | 9/1955 | Ruhlmann | 104/247 |
| 2,719,715 | 10/1955 | Leahan . | |
| 2,861,806 | 11/1958 | Disney . | |
| 3,006,286 | 10/1961 | Bacon et al. | 104/63 |
| 3,067,697 | 12/1962 | Doolittle | 104/246 |
| 3,095,827 | 7/1963 | Chadenson | 104/138 |
| 3,113,528 | 12/1963 | Morgan et al. | 104/73 |
| 3,283,418 | 11/1966 | Brewer et al. . | |
| 3,345,916 | 10/1967 | Tobias . | |
| 3,554,130 | 1/1971 | Broggie | 104/75 |
| 3,590,743 | 7/1971 | Larson | 104/130 |
| 3,672,308 | 6/1972 | Segar | 104/246 |
| 3,700,060 | 10/1972 | Keene et al. . | |
| 3,704,027 | 11/1972 | Laudadio . | |
| 3,709,104 | 1/1973 | Culberson | 91/495 |
| 3,734,222 | 5/1973 | Bardwick, III . | |
| 3,747,418 | 7/1973 | Hoffman et al. | 74/5.43 |
| 3,782,008 | 1/1974 | Lloyd . | |
| 3,803,466 | 4/1974 | Starkey | 318/135 |
| 3,805,414 | 4/1974 | Marsh . | |
| 3,849,910 | 11/1974 | Greenly . | |
| 3,886,334 | 5/1975 | Cummings et al. | 235/184 |
| 3,898,746 | 8/1975 | Seidle . | |
| 3,900,843 | 8/1975 | Ferriss . | |
| 3,903,696 | 9/1975 | Carman | 60/414 |
| 3,942,270 | 3/1976 | Hoyt et al. . | |
| 3,983,640 | 10/1976 | Cardullo et al. . | |
| 3,984,924 | 10/1976 | Myles et al. . | |
| 3,991,485 | 11/1976 | Golenski . | |
| 4,019,261 | 4/1977 | Pancoe | 248/373 |
| 4,030,207 | 6/1977 | Kron . | |
| 4,030,208 | 6/1977 | Carver et al. . | |
| 4,034,484 | 7/1977 | Radice . | |
| 4,057,913 | 11/1977 | Eisenberg . | |
| 4,059,909 | 11/1977 | Kron . | |
| 4,064,640 | 12/1977 | Cummings et al. . | |
| 4,066,256 | 1/1978 | Trumbull . | |
| 4,070,705 | 1/1978 | Lockwood et al. . | |
| 4,108,077 | 8/1978 | Laing | 104/156 |
| 4,134,217 | 1/1979 | Neilson . | |
| 4,164,080 | 8/1979 | Kosydar et al. . | |
| 4,213,343 | 7/1980 | Hoffman | 73/505 |
| 4,216,473 | 8/1980 | Goldfischer et al. | 343/8 |
| 4,236,325 | 12/1980 | Hall et al. | 434/35 |
| 4,246,848 | 1/1981 | Schneider . | |
| 4,246,978 | 1/1981 | Schulz et al. | 180/165 |
| 4,251,140 | 2/1981 | Fogerty, Jr. | 352/132 |
| 4,262,861 | 4/1981 | Goldstein | 244/3.2 |
| 4,276,028 | 6/1981 | Gwynn | 434/20 |
| 4,276,030 | 6/1981 | Radice | 434/62 |
| 4,299,576 | 11/1981 | Kron | 434/59 |
| 4,321,044 | 3/1982 | Kron . | |
| 4,347,055 | 8/1982 | Geiger | 434/30 |
| 4,349,196 | 9/1982 | Smith, III et al. . | |
| 4,398,241 | 8/1983 | Baker et al. | 364/167 |
| 4,423,365 | 12/1983 | Turner | 318/561 |
| 4,451,769 | 5/1984 | Minnich et al. | 318/689 |
| 4,457,716 | 7/1984 | Eserhaut et al. | 434/43 |
| 4,473,876 | 9/1984 | Minnich | 364/184 |
| 4,491,073 | 1/1985 | Dozer | 104/95 |
| 4,504,233 | 3/1985 | Galus et al. | 434/45 |
| 4,693,186 | 9/1987 | Lisa | 105/329.1 |
| 4,752,065 | 6/1988 | Trumbull et al. . | |
| 4,753,596 | 6/1988 | Hart et al. | 434/29 |
| 4,760,697 | 8/1988 | Heggie et al. | 180/165 X |
| 4,798,376 | 1/1989 | Trumbull et al. . | |
| 4,865,550 | 9/1989 | Chu | 434/267 |
| 4,920,890 | 5/1990 | Barber | 104/53 |
| 5,015,933 | 5/1991 | Watkins et al. . | |
| 5,028,073 | 7/1991 | Harms et al. | 280/840 |
| 5,127,657 | 7/1992 | Ikezawa et al. | 273/310 |

RIDE VEHICLE CONTROL SYSTEM

This invention relates to a control system, and more particularly, to a hydraulic control system aboard each ride vehicle that follows a path in an amusement attraction.

BACKGROUND

Ride vehicles have been a common form of entertainment for decades in amusement parks and attractions all across the country. These ride vehicles take many forms, including the forms of cars, trucks, boats, trains, spaceships, tour busses, safari vehicles, roller coaster vehicles, etc. Often, the ride vehicles may be designed to enhance a particular theme and be accompanied with intricately-designed sets that surround a path that the ride vehicles follow. In some theme parks, such as Disneyland Park,™ in California, and the Magic Kingdom Walt Disney World Park,™ in Florida, the passengers may experience a fairy tale, action adventure or other story as the ride vehicle travels through the attraction, for example, as found in the famous Pirates of the Caribbean™ attraction, of those theme parks.

A typical form of ride vehicle comprises a passenger seating area for one or more passengers, wherein the ride vehicle generally follows a fixed path, usually in the form of a track, rail system or the like. In some cases, the passenger is allowed to take a minor role in directing the lateral travel of the vehicle by steering it within a defined range along the fixed path, and by controlling its rate of speed. In other cases, a vehicle operator directs the vehicle, as typically found in safari parks and in tours of film studios. In other cases, the passenger assumes a passive role while the ride vehicle strictly follows the fixed path at a predetermined, or sometimes variable, rate of speed.

Frequently, ride vehicles in amusement attractions are permitted to move freely under the influence of gravity, their spacings regulated by the use of track-mounted hydraulic actuators that brake or restrain vehicle motion. For example, many roller coasters and log flume rides typically elevate each ride vehicle, which is thereafter motivated along the associated path by the force of gravity. The control systems of these rides may use path-mounted sensors, or alternatively, human operators positioned along the path, to control hydraulic brake mechanisms to maintain vehicle spacing.

In other vehicles, individual electric motors or other propulsion are used to drive the ride vehicles, with braking applied external to the vehicle. For example, some attractions use a plurality of platen drives, having a wheel or other path-mounted drive element that contacts a platen of each ride vehicle, to drive the ride vehicles at all locations along the path. In these systems, control systems which are external to the vehicle directly control vehicle speed, and there are typically no speed devices aboard any of the vehicles.

Still in other vehicles, propulsion is electronically actuated, frequently without the necessity of having an operator stationed in each vehicle. In these ride vehicles, electric power is supplied through a power bus, mounted adjacent to the path, which the ride vehicle taps and uses to operate its motor. A central controller is used to monitor the proximity of vehicles and shut-off power to a particular zone, or section of the path, having a ride vehicle that is closely spaced to a predecessor, or during an emergency condition.

Ride vehicles of the types described above have proven to be quite successful and provide a wide range of different experiences. However, they are not without certain recognized limitations, a principle limitation being the safety of the passengers. For example, a passenger's sensation of vehicle motion is generally dictated by the velocity of the vehicle and the shape or contour of the path followed. Thus, in order to give the passenger the sensation that the vehicle is accelerating rapidly or turning a sharp corner very fast, the vehicle must itself actually accelerate rapidly or turn a sharp corner very fast. Such rapid accelerations and sharp turns at fast speeds, however, may expose the passengers to undesirable safety risks. Additionally, control systems used to regulate a plurality of such ride vehicles often require manual operation, or generally operate control elements external to the ride vehicles to arrest motion.

Another well known limitation of ride vehicles of the type described above is that they generally follow a singular, predetermined path throughout the attraction. As a result, the passenger is left with little or no versatility in the ride experience. Moreover, since the vehicle follows only one path throughout the attraction, the passenger is exposed to the same ride experience each time. Generally, this leaves the passenger with less incentive to ride the attraction more than once, since the ride experience will be the same each time. The time and expense associated with changing the ride experience, either by altering the vehicle path or replacing the ride scenery, usually are prohibitive.

In recent years, simulators have been used to simulate vehicle motion, and are typically operated entirely within a room or other enclosed area. These motion simulators generally comprise a passenger seating area that is articulated by a platform-mounted, hydraulically-actuated motion base. The platform is fixed and does not move; rather, motion is imparted to the passenger seating area by multiple actuators, which form a part of the motion base. In use, passengers seated in the passenger seating area are typically shown a motion picture film that corresponds to a pre-determined pattern of vehicle travel. This motion picture film presents images in the same manner that one seated within an actual moving vehicle would see those images, and induces the passengers within the room to believe that they too are in the moving vehicle. To create this effect, the motion base articulates the passenger seating area in appropriate directions to actually impart gravity and other forces to the passengers, in exact synchronization with particular visual images projected from the film. For example, when the sensation of acceleration is required, the passenger seating area is slowly pitched backward, practically undetectably, and then just as the motion picture film imparts the impression of acceleration, rapidly pitched forward (through rotational acceleration) to a level position. When the sensation of turning a corner is required, the passenger seating area is undetectably rolled to one side and then back to a level position during the course of the simulated turn, in cooperation with the film's depiction of an actual "turn." Other vehicle motion sensations can be simulated using appropriately projected visual images and synchronized articulated motion of the passenger seating area. Thus, passengers can be made to experience motion as if they were in a moving vehicle without ever leaving the room, and without the need of a single control system that collectively governs a plurality of simulators. One well-known simulator that has been used successfully for years is the so-called "Star Tours"™ attraction at Disneyland Park™ in Anaheim, Calif.

The precision of the articulation and timing in a simulator ride is acute, and often requires the use of a computer to control the movements of hydraulic actuators within the motion base. Typically, a number of electronically-controlled, piston-type actuators of the motion base support the passenger seating area with respect to the platform. When supplied with a variable amount of voltage, each of these actuators is hydraulically stroked in a repeatable, controlled amount that varies in dependance upon the amount of voltage. Using a plurality of actuators, therefore, the passenger seating area can be articulated to supply the motions of vertical lift, side-to-side movement, front-to-back movement, roll, tilt and yaw and any combination of these motions.

To synchronize the presentation of the projected images with articulation of the passenger seating area, the computer is programmed with a sequence of data, each event in the sequence defining a particular attitude of the passenger seating area with respect to the platform. Furthermore, this sequence of events is indexed to the start of the film (motion picture film is driven at a constant rate of 24 frames per second), such that articulation of the passenger seating area is properly synchronized with the sense of motion in the projected images. Accordingly, to generate a particular, preconceived ride experience, the film must first be created, after which programmers experiment with articulation of the motion base to derive and index ideal motions to a particular time or frame of the motion picture film.

While simulators of the type described above have come a long way to provide more dynamic and enhanced sensations of simulated vehicle movement, such simulators are not true vehicles and still do not actually move the passenger through an attraction. Instead, the simulator remains in a fixed position while the passenger seating area tilts in various directions corresponding to the simulated path of travel shown by the film. Therefore, the passenger does not actually travel through live scenery and props, which might otherwise pass by the passenger if the vehicle were to physically travel through a live attraction. Motion picture film, no matter how realistic, present a two-dimensional image that does not accurately recreate the impression that an actual three-dimensional object produces. Thus, the more conventional ride vehicles present the relative advantage that they do move and do encounter actual objects, sets, animals, and environments, that impart a vivid, three-dimensional impression upon the passengers. Furthermore, simulators also are limited in the sense that the passenger must usually look forward toward the screen upon which the motion picture film is shown, in order to obtain and maximize the ride experience. Thus, the simulator effect seeming presence in a moving vehicle is limited by the fact that passengers cannot look sideways, or behind the vehicle.

In addition, unless the motion picture film used in a simulator attraction is occasionally changed, and the motion pattern of the simulator reprogrammed to produce movement corresponding to a new motion picture film, which, as explained above, is an expensive and labor intensive undertaking, then the passengers will be exposed to the same ride experience each time they visit the attraction. Therefore, like the conventional ride vehicles described above, there is generally less incentive for the passenger to repeatedly ride a simulator-ride, as the ride experience will be the same each time.

Accordingly, there has existed a need for a ride vehicle that enhances the sensation of the vehicle's motion and travel experienced by passengers as the ride vehicle itself physically moves through an actual, three-dimensional attraction. For such an attraction, there also exists a corresponding need to utilize a plurality of such ride vehicles at any one particular time, and a method of ensuring that they may be safely operated and controlled. Finally, there exists a need to have a simulator-type attraction which may be readily implemented in a multitude of environments, and which therefore can readily and inexpensively provide a multitude of ride experiences and utilize the same type of control to achieve these ride experiences in each of these environments. The current invention solves these needs and provides further, related advantages.

SUMMARY OF THE INVENTION

The present invention presents a control system for an amusement ride vehicle that enables safe, reliable movement of passengers through the amusement attraction. Using the principles of the present invention, therefore, passengers may travel through the amusement attraction and have vehicle motions synchronized with the external, three-dimensional environment that is presented to them. Movement sensations and forces felt or expected by the passengers may be enhanced, diminished, created, negated or otherwise modified to give the passengers a unique and infinitely-variable ride experience.

The present invention presents a ride vehicle control system that hydraulically actuates at least one actuator, and that includes a hydraulic power unit having a source of hydraulic fluid, an accumulator charged with hydraulic energy produced by the hydraulic power unit, and a regulator that regulates the flow of hydraulic energy from the accumulator to the hydraulically-operated actuator. More particularly, preferred forms of the present invention may feature an electric motor that derives power from a power bus to turn a hydraulic pump to pump the hydraulic fluid from a reservoir into the accumulator and to thereby drive vehicle motion, vehicle steering, or motion base actuation that articulates the passenger holding structure to present special motion effects to the passengers. Preferably, the ride vehicle includes at least three hydraulically-operated motion base actuators, two hydraulically-operated steering actuators, and a hydraulically-operated motor that provides the impetus for ride vehicle motion, each receiving their hydraulic energy via a central manifold and returning hydraulic fluid to the reservoir.

Thus, the present invention allows the preferred embodiment, a ride vehicle having a special motion base and an electronic control system, to articulate passengers in synchronism with (1) motion of the ride vehicle, including accelerations and turns, (2) movement of external show sets, i.e., falling artificial boulders, etc., (3) music and other sounds and (4) other effects as appropriate. This synchronism is orchestrated by the electronic control system and effectuated in nearly instantaneous fashion with the hydraulic control system, discussed herein. As a number of ride vehicles are preferably steered on a track upon which the ride vehicles travel, within an envelope, the power bus permits a uniform, controlled power source to be used for the entire amusement ride attraction.

The invention may be better understood by referring to the following detailed description, which should be read in conjunction with the accompanying drawings. The detailed description of a particular preferred embodiment, set out below to enable one to build and use one particular implementation of the invention, is not intended to limit the enumerated claims, but to serve as a particular example thereof.

DETAILED DESCRIPTION

Figure 1:
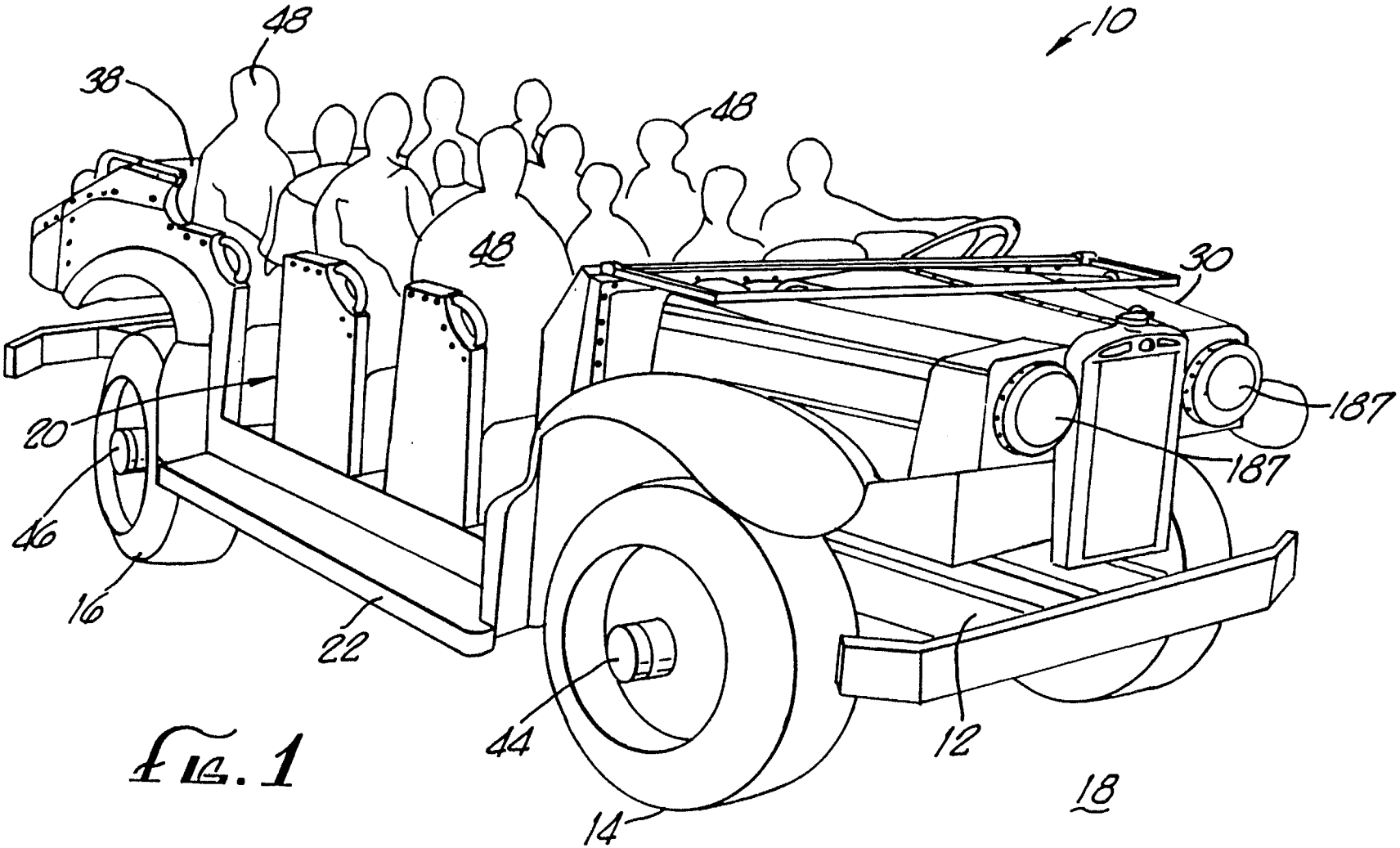
FIG. 1 is a front perspective view of an amusement ride vehicle embodying the novel features of the invention.

The invention summarized above and defined by the enumerated claims may be better understood by referring to the following detailed description, which should be read in conjunction with the accompanying drawings. This detailed description of a particular preferred embodiment, set out below to enable one to build and use one particular implementation of the invention, is not intended to limit the enumerated claims, but to serve as a particular example thereof. The particular example set out below is the preferred specific implementation of a control system that is used to control a ride vehicle in an amusement attraction.

The present invention is a hydraulic control system that is preferably used to drive a ride vehicle in an amusement attraction to both propel the vehicle and to motivate each of a plurality of mechanical actuators onboard the vehicle as it follows a path 18. Each ride vehicle 10 preferably incorporates a passenger holding structure 20 and a motion base 24, which articulates the passenger holding structure with respect to the ride vehicle 10 to present passengers 48 with forces that are synchronized to movement of the ride vehicle, to projection visible to the passengers, or to moving show sets that are external to the vehicle.

Thus, unlike prior simulator rides, real three-dimensional objects, motion and directional changes are presented to the passengers by movement of the ride vehicle 10. The passenger holding structure 20 is articulated in synchronism with either motions of the ride vehicle or of external show sets, to create forces upon the passengers that convince them, for example, that their speed is faster than actual vehicle speed, or that they are under large gravitational forces, etc. In addition, the motion base 24 can impart motion to convince the passengers that they are on varying terrains, such as cobblestone roads, rivers, or other terrain. All of these effects are obtained by the combined use of the passengers' visual observation of their three-dimensional surroundings, with articulation of the motion base 24 synched to vehicle motion and to those surroundings. Preferably, each amusement attraction includes the path 18, scenery including moving show sets and stationary show sets, and a plurality of ride vehicles 10 that each execute one or more different ride programs that control motion of the vehicle and articulation of the passenger holding structure 20.

Before proceeding to a discussion of the preferred hydraulic control system that implements the present invention, it will first be helpful to describe the operation of the ride vehicle 10 that is the preferred domain of the present control system.

Figure 2:
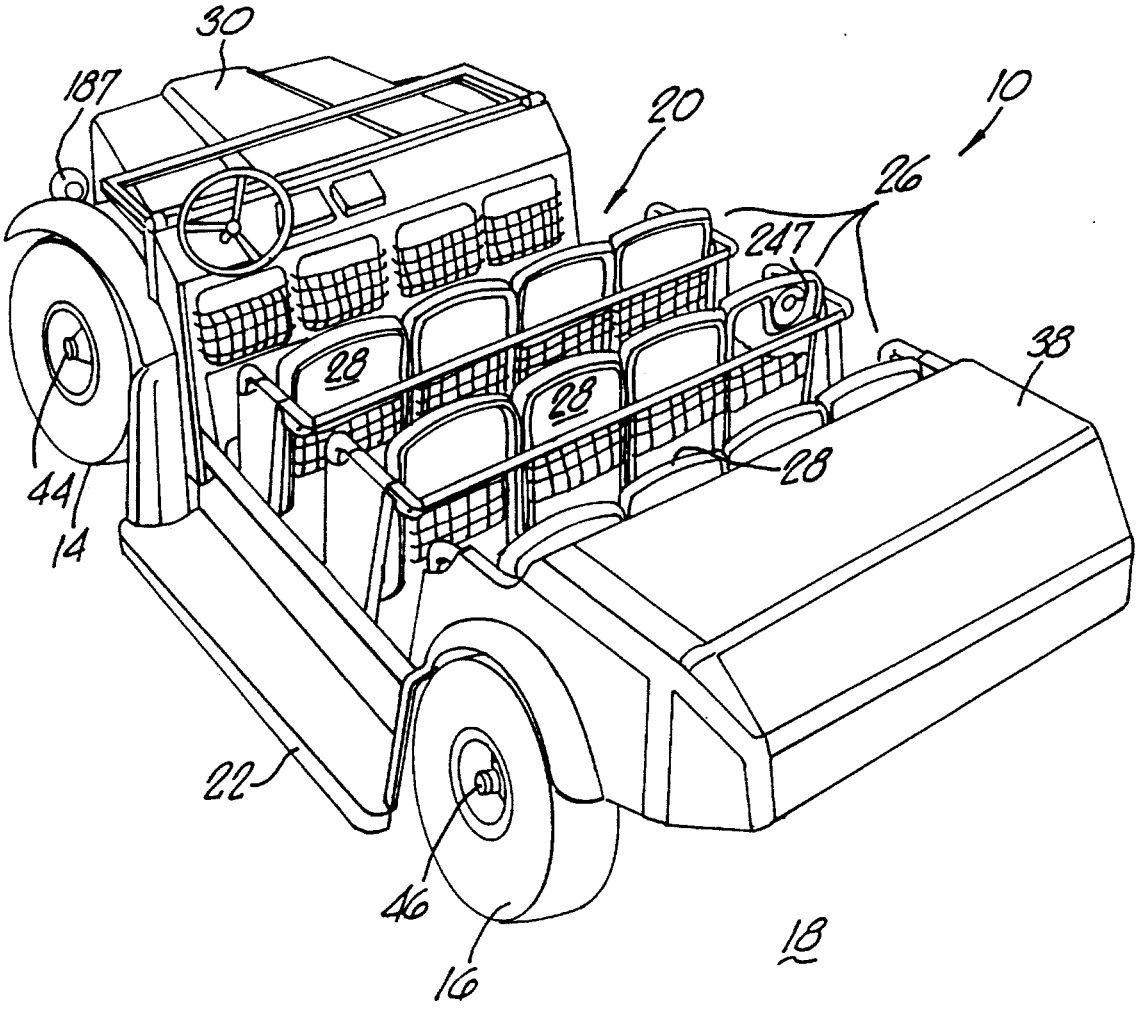
FIG. 2 is a rear perspective view of the ride vehicle.

Configuration And Operation Of A Ride Vehicle Modelled As An All-Terrain Off-Road Vehicle As seen in FIGS. 1 and 2, the ride vehicle 10 is used to carry passengers and entertain and amuse guests in an amusement park attraction or the like. Although the ride vehicle of the invention may take many forms, including that of a boat, plane, train, spaceship, fantasy ride vehicle, animal, etc., the preferred implementation of the ride vehicle 10 comprises a ride vehicle chassis 12 having front wheels 14 and rear wheels 16 for steering the ride vehicle along the path 18 throughout the attraction. The guests or passengers are seated in a passenger holding structure 20 in a ride vehicle body 22 connected to the ride vehicle chassis 12. In accordance with the invention, a special motion base 24 supports the passenger holding structure 20 with respect to the vehicle and selectively imparts motion to the passenger holding structure in multiple degrees of freedom, independent of any directional motion of the ride vehicle 10 along the path 18. This unique arrangement significantly enhances the sensation of ride vehicle movement experienced by the passengers riding in the ride vehicle 10.

As mentioned, the ride vehicle body 22 can take various forms resembling, for example, an all-terrain vehicle, a jeep, a car or truck, or various other forms of either on or off-road transportation ride vehicles. The body 22 depicted in the accompanying drawings has been designed to resemble an all terrain-type vehicle. It will be understood, however, that various other body shapes may be employed as desired. Therefore, the details of the body exterior will not be discussed further.

The passenger holding structure 20 includes several rows 26 of seats 28, with four seats in each row. Other seating arrangements can be used depending upon the size and shape of the body 22 and the particular type of ride experiences to be conveyed. Passenger restraints can be provided to restrain the passengers and confine them safely in their seats during ride vehicle motion. A suitable passenger restraint system is disclosed and claimed in U.S. Pat. No. 5,182,836.

The front portion of the body 22 includes a hood 30 which encloses the major power components of the ride vehicle, such as an electric motor 32, a hydraulic power unit 34 and a hydraulic propulsion motor 36. The rear portion of the body 22 includes trunk area 38 enclosing a computerized vehicle-control system 40 and a sound module 41 for generating sounds corresponding to the sounds of the ride vehicle 10 interacting with the path 18, scenery 42 and other props positioned at selected locations in the attraction. Further details regarding the ride vehicle's power components, computerized vehicle-control system 40, sound module 41 and other props are discussed in more detail below.

The ride vehicle chassis 12 has a front axle 44 and a rear axle 46, with the front and rear wheels 14 and 16 connected to the opposite ends of each axle, respectively. Each wheel 14 and 16 is equipped with a suitable tire, such as an inflatable tire or the like. Emergency braking of the ride vehicle 10, and application of a parking brake, are carried out with spring-applied, hydraulic-release disc brakes on all four wheels. If system power fails, spring energy causes the brakes to "fail" on. In one aspect of the preferred ride vehicle, the front wheels 14 and the rear wheels 16 each have a separate steering system which allows the front wheels 14 and the rear wheels 16 to be steered independently of each other. The steering system is capable of providing a yaw axis of motion for the ride vehicle 10. This enables various motion patterns of the ride vehicle 10 not capable with conventional front or rear wheel steering.

In accordance with the preferred ride vehicle, the motion base 24 is integrated into the ride vehicle chassis 12 for imparting motion in multiple degrees of freedom the passenger holding structure 20, independently of the motion of the ride vehicle 10 along the path 18. When properly manipulated through an appropriate motion control system, the motion base 24 can raise the passenger holding structure 20 and tilt it along several axes of motion to substantially enhance the sensation of ride vehicle movement experienced by the passengers 48 riding in the ride vehicle 10. In some situations, motion of the passenger holding structure 20 with respect to the ride vehicle chassis 12 can be designed to enhance the sensation of ride vehicle movement that is actually taking place. In other situations, such motion can be designed to provide the passengers 48 with a realistic moving ride vehicle experience which is actually not taking place. In the preferred implementation of the ride vehicle, the body 22 is also articulated with the passenger holding structure 20 with respect to the ride vehicle 10, and in particular, with respect to the ride vehicle chassis 12 of the ride vehicle.

In addition, using sensors which are coupled to specific mechanical elements to determine the extent of their stroke, i.e., rear wheel steering, the motion base 24 can be made to react to ride vehicle motions, as interpreted by the computerized vehicle-control system 40. In the preferred implementation of this ride vehicle 10, however, the mechanical elements that effect the ride experience, including velocity, rear offset of the ride vehicle from center, and the motion base 24 are all controlled by the computerized vehicle-control system 40 in accordance with a selected sequence of data, stored within the computerized vehicle-control system 40.

Figure 3:
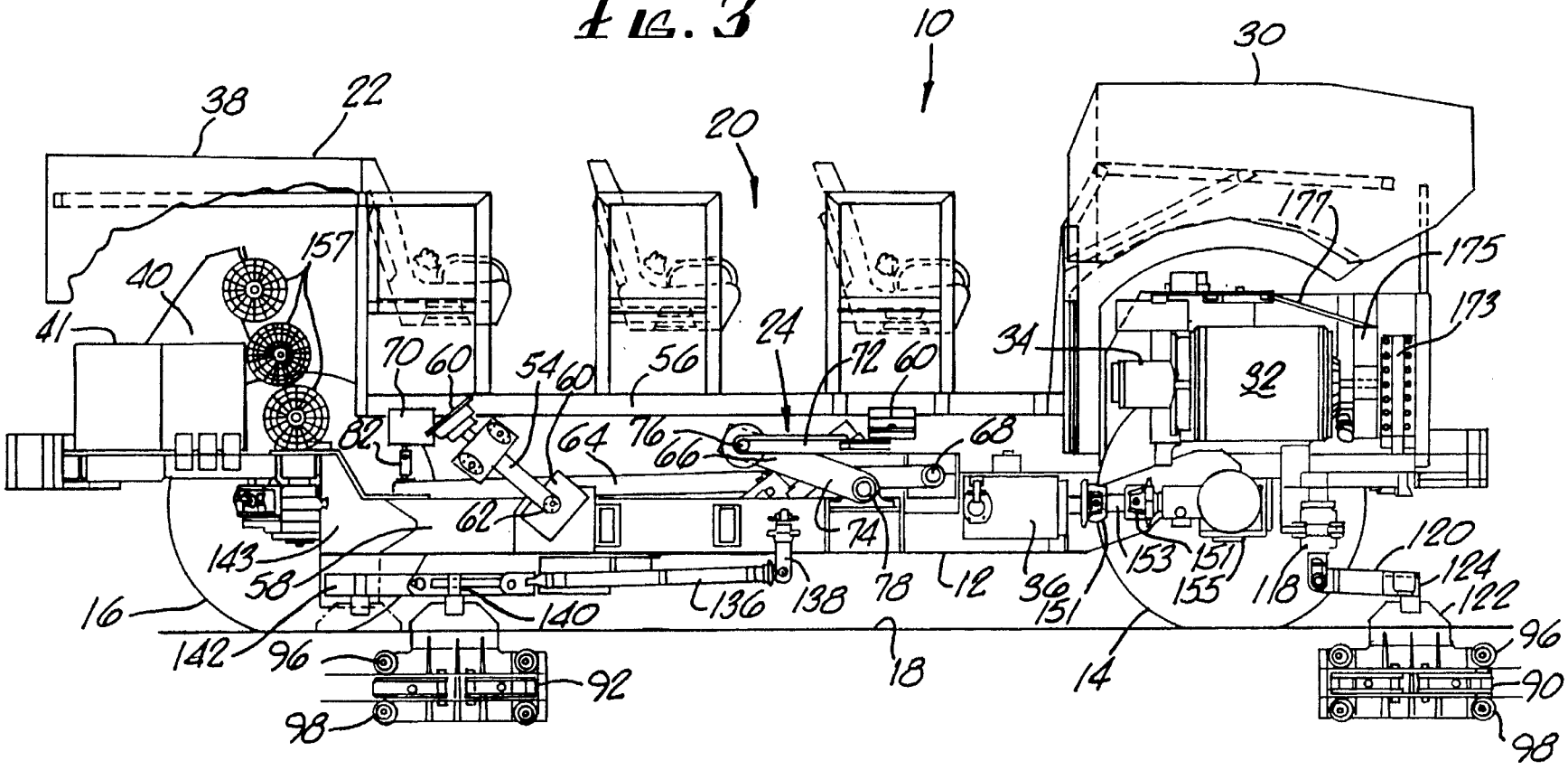
FIG. 3 is a side elevational view of the ride vehicle, partly in cross-section, showing a passenger holding structure in a normal, horizontal position relative to the vehicle chassis.

One form of the motion base 24 is illustrated in FIGS. 3–7, with various details Of the ride vehicle body 22 and ride vehicle chassis 12 having been omitted for purposes of clarity and simplification. This embodiment of the motion base 24 uses three hydraulic servo actuators comprising a front-left motion base servo actuator 50, a right-front motion base servo actuator 52 and a rear motion base servo actuator 54. The motion base 24 also includes a body support platform or frame 56 securely connected to or integrated with the body 22 so as to form the underside of the body 22. All three of the actuators 50, 52 and 54 have their lower ends pivotally connected to a base portion 58 of the ride vehicle chassis 12 by separate mounting brackets 60, Similarly, mounting brackets 60 are also used to pivotally couple the upper ends of the actuators 50, 52 and 54 to the body support frame 56 (i.e., to the passenger holding structure 20 and the body 22). Each of these brackets 60 is adapted to receive a fastener 62 to secure the actuators 50, 52 and 54 to the mounting brackets 60. As seen in FIG. 3, for example, two of the actuators 50 and 52 in this embodiment are forward mounted and have their upper ends pivotally connected directly to the front portion of the body support frame 56 by separate brackets 60. The third actuator 54 is mounted rearward of the other two and has its upper end pivotally connected to the rear portion of the body support frame 56.

The motion base 24 also comprises two motion control arms comprising an A-arm 64 and a scissors 66. The A-arm 64 preferably is a bolted steel structure, and the scissors 66 preferably is a welded tubular steel frame. As shown best in FIG. 6, the A-arm 64 has its front end pivotally connected by brackets 68 to the front end of the ride vehicle chassis 12 and its rear end pivotally connected by brackets 70 to the rear portion of the body support frame 56 adjacent to the rear motion base servo actuator 54. The scissors 66 comprises a folding linkage in the form of two links 72 and 74 connected together at a pivot point 76. The lower end of the scissors 66 is pivotally connected by a bracket 78 to the ride vehicle chassis 12 adjacent to the two front motion base servo actuators 50 and 52, and the upper end of the scissors 66 is connected by a bracket 80 to the front portion of the body support frame 56 adjacent to the two front motion base servo actuators 50 and 52. In order to permit rolling motion of the body 22 with respect to the ride vehicle chassis 12, universal joints 82 are employed to connect the body support frame 56 to the rear end of the A-arm 64 and the upper end of the scissors 66.

With the foregoing arrangement, the A-arm 64 is adapted to be pivoted up and down about the pivot points where the A-arm is connected to the ride vehicle chassis 12, while the body support frame 56 is adapted to be rolled from side to side about the pivot points where the frame is connected to the A-arm 64 and scissors 66 by the universal joints 82. This configuration of the motion base 24 allows the body 22 to be rolled from side to side about an imaginary roll axis, pitched forward and backward about an imaginary pitch axis, and elevated up and down with respect to the ride vehicle chassis 12. However, the A-arm 64 and scissors 60 constrain longitudinal forward and rearward shifting, lateral side to side shifting and yaw movement of the body 22 with respect to the ride vehicle chassis 12.

It will be appreciated that alternative forms (not shown) of the motion base 24 can be provided. For example, the motion base 24 may comprise six actuators arranged in combinations of two to form a 2+2+2 motion base arrangement. By controlling movement of these actuators, the body 22 may be rolled from side to side, pitched forward and backward and elevated up and down with respect to the ride vehicle chassis, as in the embodiment of the motion base of FIG. 3. Other motion capabilities with these six actuators, however, include longitudinal front and rear shifting, lateral side-to-side shifting and yaw movement of the passenger holding structure 20 and body 22, with respect to the ride vehicle chassis 12.

Another alternative form of the motion base 24, for example, can include six actuators forming a 3+motion base arrangement, with three of the actuators rearward mounted and three forward mounted. This configuration of the motion base 24 allows the body 22 to be rolled from side to side, pitched forward and backward and elevated up and down with respect to the ride vehicle chassis, as in the embodiment of the motion base of FIG. 3. Other movements, however, include longitudinal forward and rearward shifting, lateral side to side shifting and yaw movement of the passenger holding structure 20 with respect to the ride vehicle chassis 12.

In still another alternative embodiment of the motion base 24, for example, three actuators can be arranged in a 1+2 motion base arrangement, in combination with a Watts linkage, to allow body movement with respect to the ride vehicle chassis 12 similar to that described above in connection with the embodiment of FIG. 3. However, the Watts linkage constrains longitudinal front and rear shifting, lateral side-to-side shifting, and yaw movement of the passenger holding structure 20 with respect to the ride vehicle chassis 12.

In the preferred configuration of the all-terrain ride vehicle 10, discussed herein, the passenger holding structure 20 and the body 22 are fixed with respect to one another and are articulated together by the motion base 24. However, one aspect of the present invention encompasses articulation of the passenger holding structure 20 with respect to the ride vehicle 10, and it should be understood that any reference to articulation of the body 22 is a particular reference to the structure of the preferred embodiment, mentioned just above, where both of the body and the passenger holding structure are articulated as a single unit. Articulation of the passenger holding structure 20, with or without the body 22, is a design choice, and both implementations are equivalent and within the scope of the present invention.

FIG. 3 is a side elevational view, partly in cross-section, showing the passenger holding structure 20 in a normal, horizontal position relative to the ride vehicle chassis 12. In this position, each of the motion base servo actuators 50, 52 and 54 is retracted to a totally collapsed condition such that the ride vehicle 10 appears to resemble any other typical roadway ride vehicle. The motion base 24, including its actuators 50, 52 and 54 and other controls, is adapted to react to a wide range of motion commands, including highaccelerations, low-velocities, smooth transitions and imperceptible washout to a static condition. The motion base 24 preferably is designed to be interchangeable from one ride vehicle to another, as are all of the other components of the ride vehicle 10 described herein.

The motion base 24 is intended to replicate a broad range of ride vehicle motions during a ride. As explained in more detail below, these motions can be programmed in conjunction with an amusement park attraction to provide a unique ride experience to the passengers 48. Moreover, each ride vehicle 10 is adapted to store more than one such sequence of motion patterns, so that the ride vehicle ride and action is not necessarily the same from one ride to the next. These alternative sequences of data (that create the motion patterns) are programmed and stored by a programmer during the development of an attraction, with the aid of a separate programming console. The ride programs are then burned into $E^2$PROM for subsequent alternative use by the ride vehicles' computerized vehicle-control systems.

When the ride first starts, the passenger holding structure 20 will be in the fully settled or down position, as shown in FIG. 3, to allow the passengers 48 to unload and load. In this position, the motion base servo actuators 50, 52 and 54 are fully collapsed and the forces of gravity can move the passenger holding structure 20 and the body 22 to the down position. If desired, the actuators 50, 52 and 54 can be commanded to go to a collapsed condition when it is necessary to quickly move the passenger holding structure 20 to the down position, such as at the end of the ride.

Figure 4:
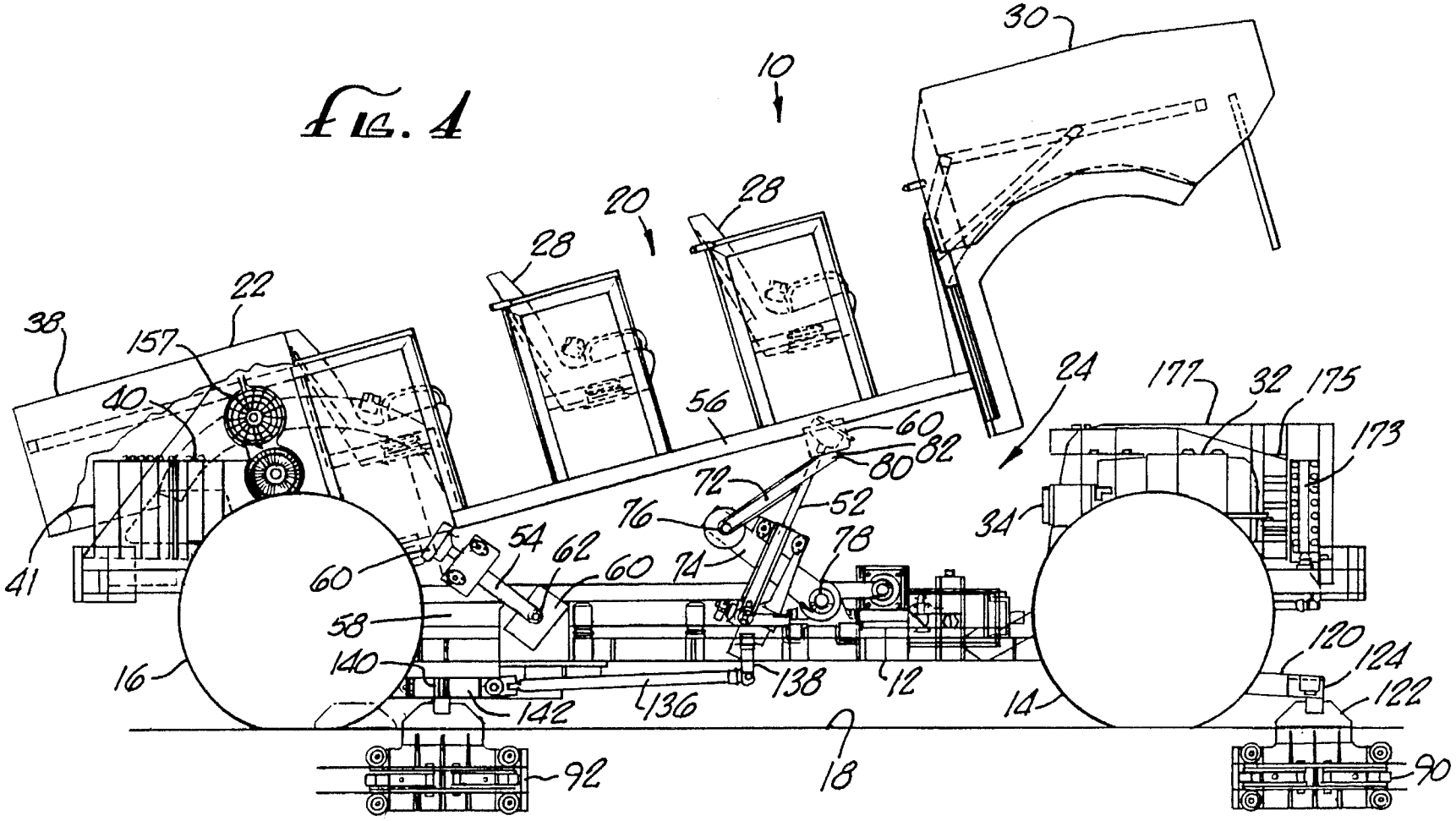
FIG. 4 is another side elevational view of the ride vehicle, similar to FIG. 3, showing the passenger holding structure pitched rearward with respect to the chassis about a pitch axis.

FIGS. 4–7 show examples of the range of motion of the passenger holding structure 20 and body 22 with respect to the ride vehicle chassis 12. By using three motion base servo actuators 50, 52 and 54, the motion base 24 is capable of providing motion in three degrees of freedom to provide body movements with respect to the ride vehicle chassis. For example, FIG. 4 shows the passenger holding structure 20 pitched in a rearward direction about the pitch axis of the ride vehicle 10. The two front actuators 50 and 52 provide movement of the passenger holding structure 20 in this manner, while the rear actuator 54 is moved only slightly or not at all. Power for movement of the actuators 50, 52 and 54 is derived from the on-board ride vehicle hydraulic system. Position sensors 84 on the actuators provide the position of the passenger holding structure 20 to the computerized vehicle-control system 40. In the preferred embodiment, these sensors 84 are non-contact, absolute position, magnetostrictive-type sensors that provide a servo signal output, fed to the computerized vehicle-control system, as discussed below. Using the sensors 84, the degree of pitch of the passenger holding structure 20 with respect to the ride vehicle 10 may be accurately controlled as desired. In the preferred embodiment, the passenger holding structure 20 and the body 22 can be pitched rearward by as much as 15.9 degrees.

Figure 5:
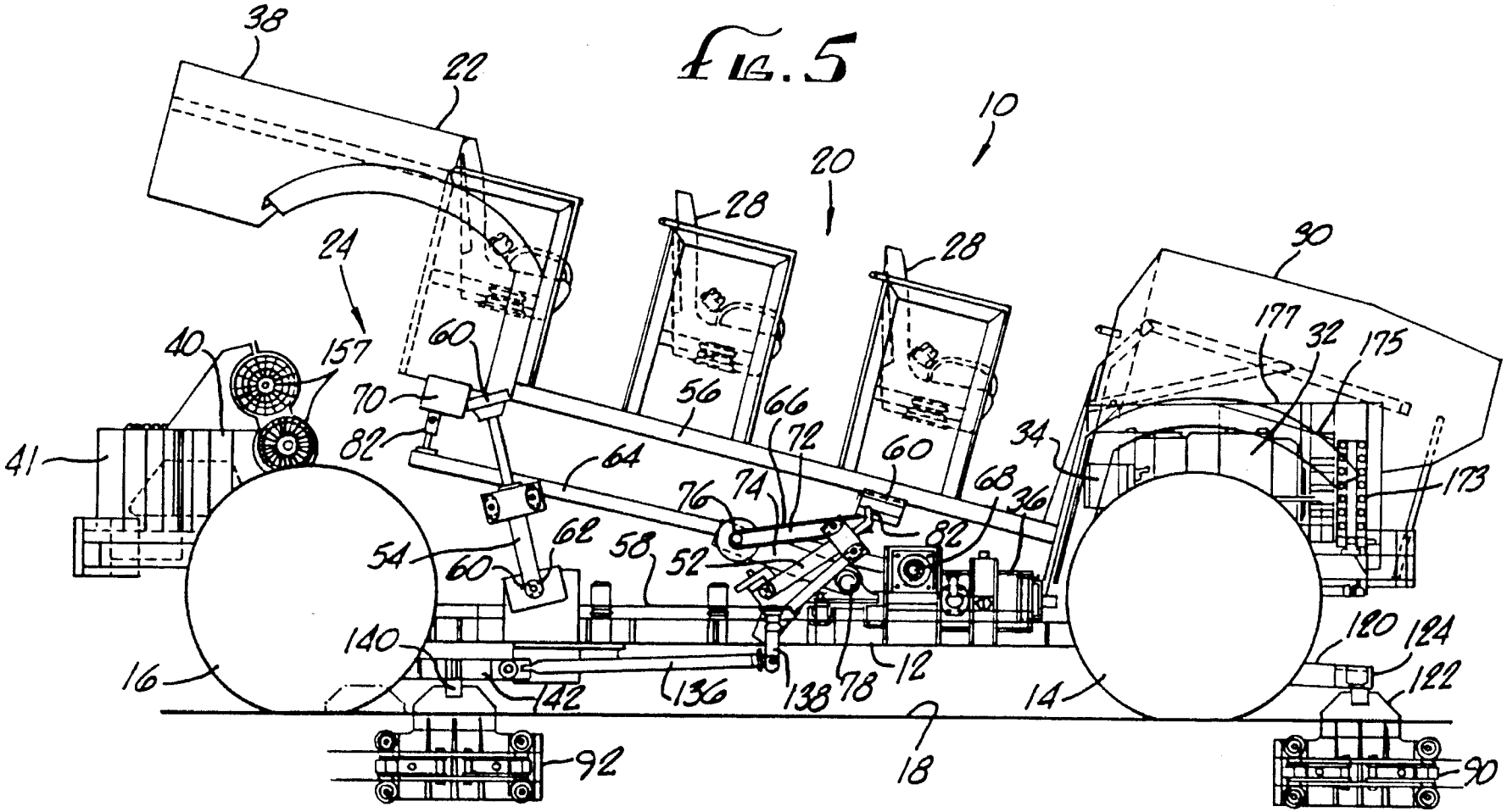
FIG. 5 is another side elevational view of the ride vehicle, similar to FIG. 3, showing the passenger holding structure pitched forward with respect to the chassis about the pitch axis.

FIG. 5 shows the passenger holding structure 20 and the body 22 pitched in a forward direction relative to the ride vehicle chassis 12. This pitching motion is achieved by supplying appropriate hydraulic power to the rear actuator 54 to raise the rear end of the body 22, while the two forward actuators 50 and 52 are moved only slightly or not at all. This forward pitching motion of the body 22 with respect to the ride vehicle chassis 12 occurs about the pitch axis of the ride vehicle 10. In the preferred embodiment, the passenger holding structure 20 and the body 22 can be pitched forward by as much as 14.7 degrees. In both cases of forward or rearward pitching of the body 22, the movement of the actuators 50, 52 and 54 causes either a constant velocity movement or rotational acceleration of the passenger holding structure 20 and the body 22 with respect to the ride vehicle chassis 12 about the pitch axis.

Figure 6:
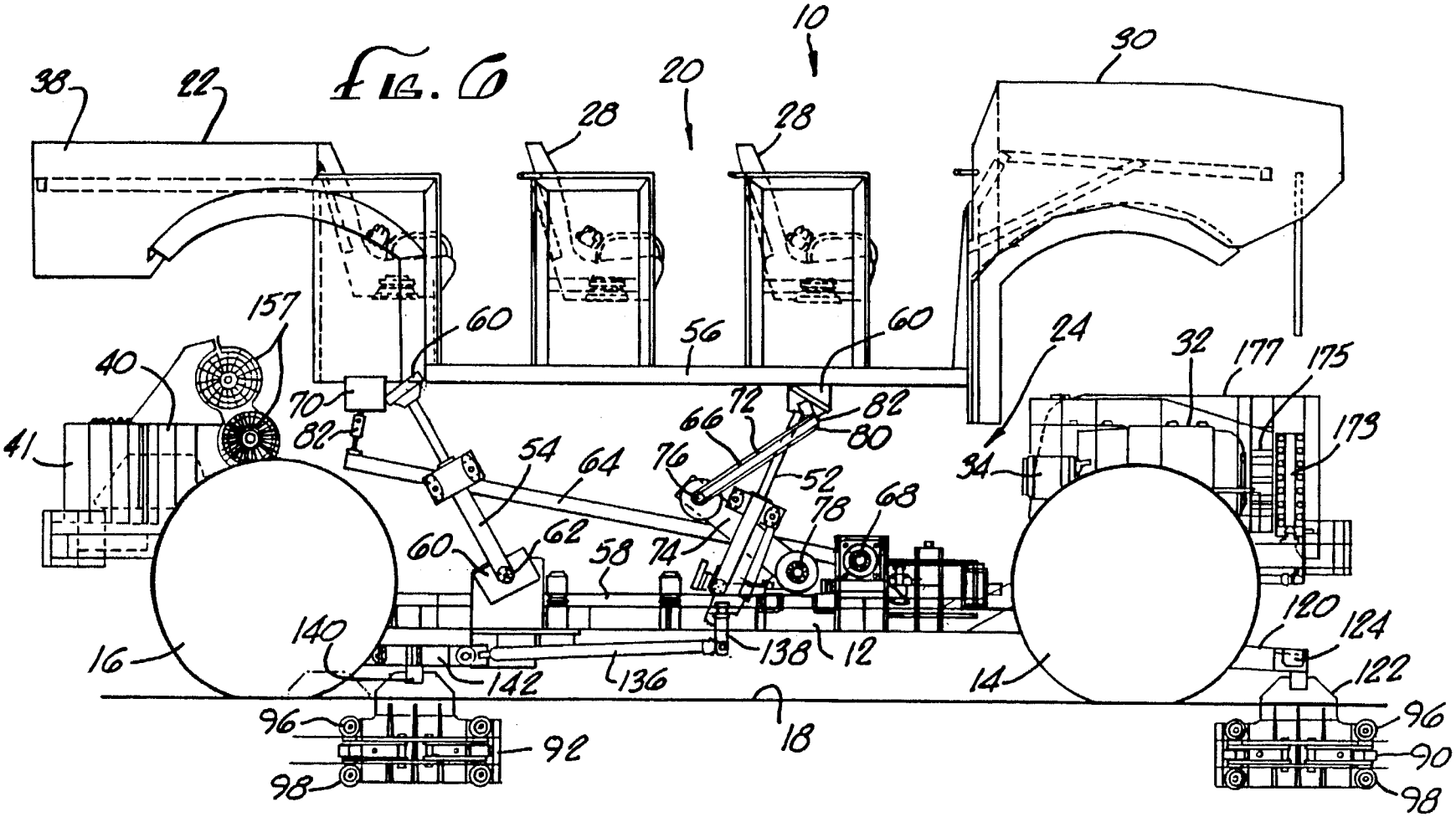
FIG. 6 is another side elevational view of the ride vehicle, similar to FIG. 3, showing the passenger holding structure in an elevated, horizontal position with respect to the chassis.

FIG. 6 shows all three actuators 50, 52 and 54 in a fully extended position, raising the passenger holding structure 20 to an elevated, horizontal position with respect to the ride vehicle chassis 12. This is accomplished by supplying appropriate hydraulic power to all three actuators 50, 52 and 54 so that they are fully extended. In the preferred embodiment, the passenger holding structure 20 and body 22 can be elevated by as much as 15 inches above the ride vehicle chassis.

Figure 7:
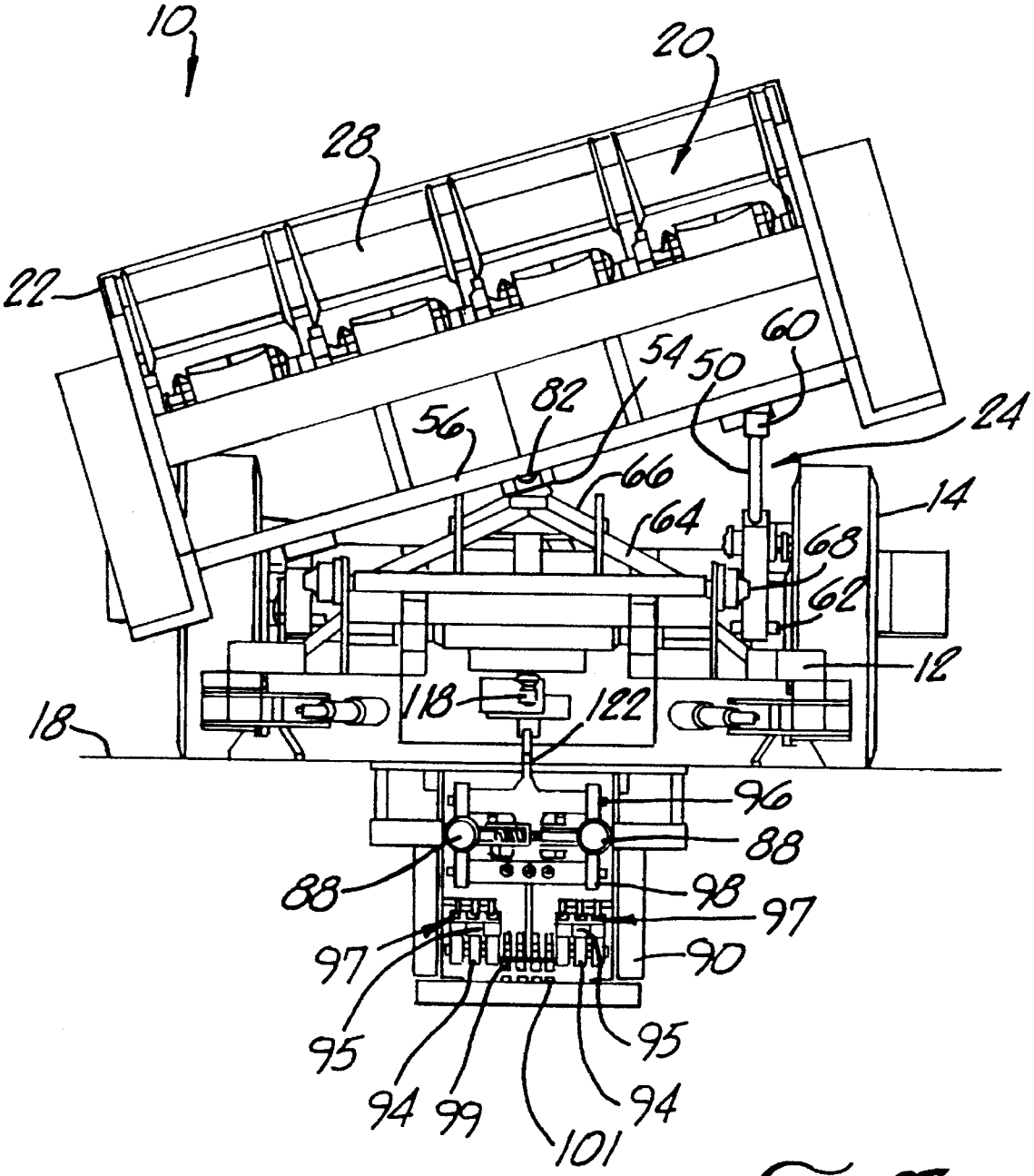
FIG. 7 is a front elevational view of the ride vehicle, partly in cross-section, showing the passenger holding structure rolled to one side with respect to the chassis about a roll axis.

FIG. 7 is a front elevational view of the ride vehicle 10, showing the passenger holding structure 20 and the body 22 rolled with respect to one side of the ride vehicle chassis 12. This is accomplished by supplying appropriate hydraulic pressure to the actuators 50, 52 and 54, resulting in rotational acceleration of the passenger holding structure 20 and the body 22 with respect to the ride vehicle chassis 12 about the roll axis of the ride vehicle 10. In this condition, one of the two front actuators 50 is extended while the other actuator 52 is collapsed. The rear actuator 54 also is partially extended to the extent necessary to accommodate extension of the one front actuator 50. In the preferred embodiment, the passenger holding structure 20 and the body 22 can be rolled by as much as 16.1 degrees to either side of the ride vehicle chassis 12. Again, it will be understood that various intermediate ranges of motion, and motion in the opposite direction to that shown in FIG. 7, are possible about the roll axis of the ride vehicle 10.

It also will be understood that intermediate ranges of motion are possible, beyond the full range of motions described above and depicted in FIGS. 4–7. For example, the passenger holding structure 20 and the body 22 can be both pitched forward and rolled to one side with respect to the ride vehicle chassis 12 by as much as 8.2 degrees (pitch) and 15.4 degrees (roll). Similarly, the passenger holding structure 20 and the body 22 can be both pitched rearward and rolled to one side with respect to the ride vehicle chassis 12 by as much as 7.2 degrees (pitch) and 17.4 degrees (roll). These motions can be carried out by appropriate control and extension and retraction of the motion base servo actuators 50, 52 and 54 in a multitude of combinations. Therefore, it is understood that the motions described herein are by way of example only and not limitation.

Figure 8:
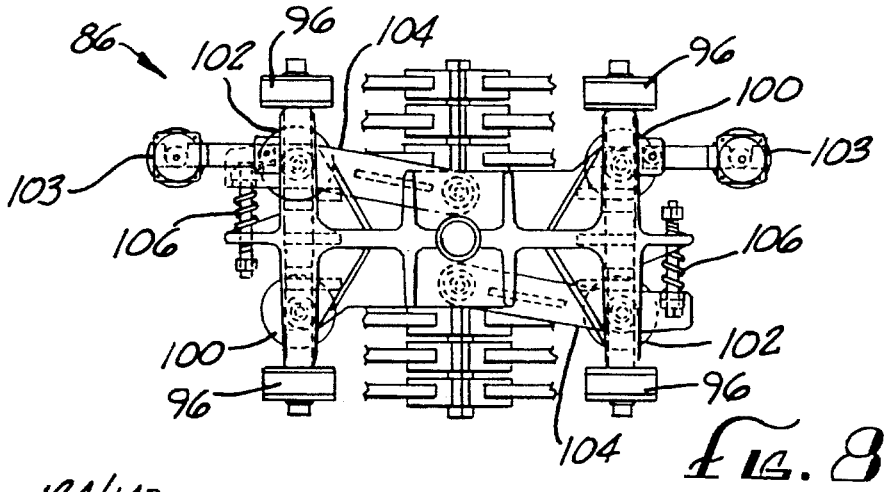
FIG. 8 is a top plan view of a bogie for use in guiding the ride vehicle along a track or path.
Figure 9:
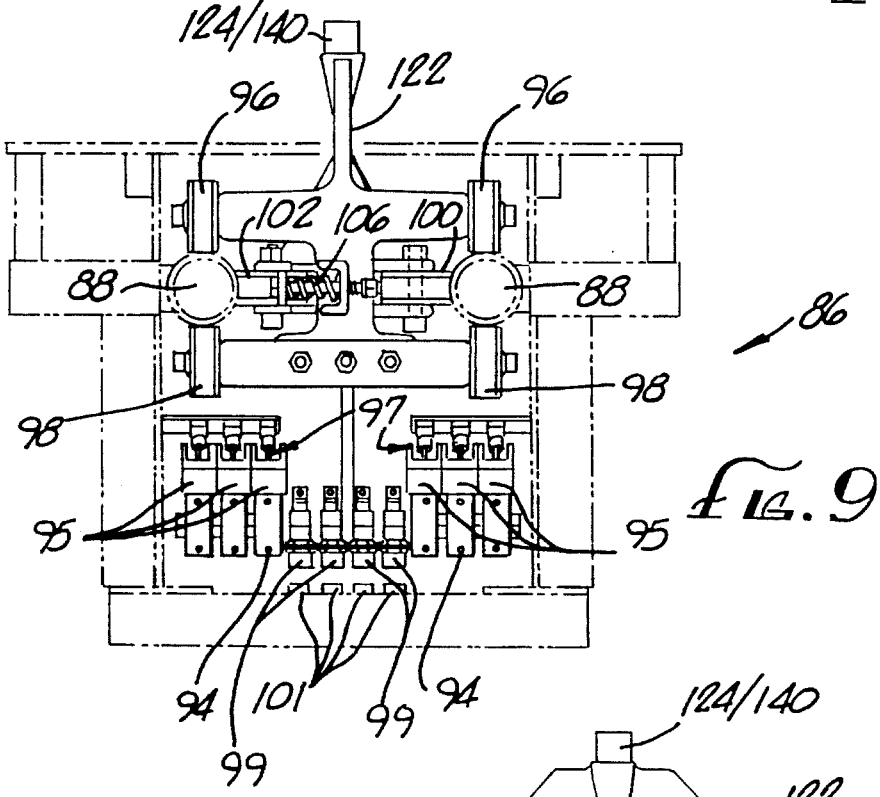
FIG. 9 is a front elevational view of the bogie.
Figure 10:
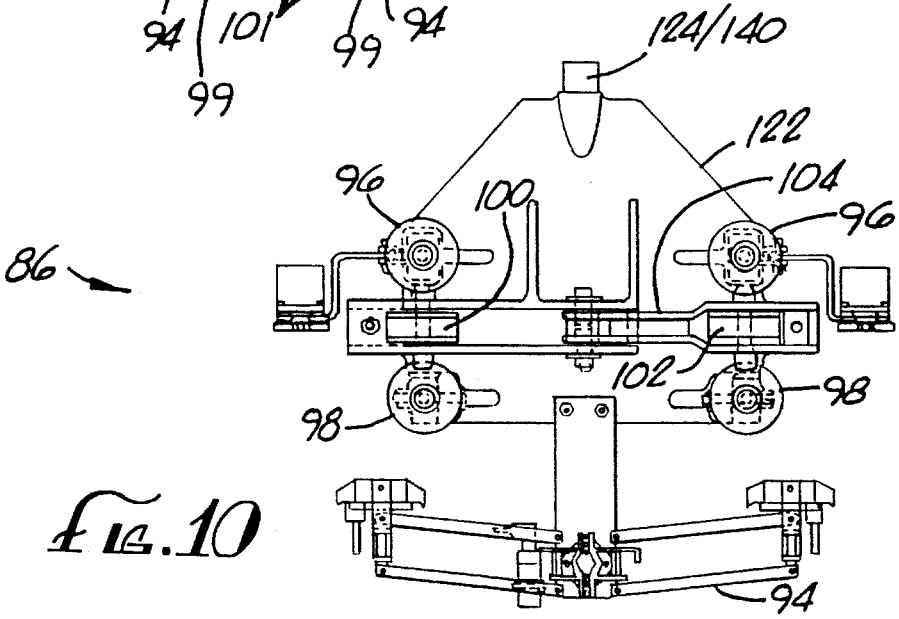
FIG. 10 is a side elevational view of the bogie.

FIGS. 8–10 show a bogie apparatus 86 for connecting the ride vehicle 10 to underground rails 88 below the surface of the path 18 upon which the ride vehicle 10 travels. In the preferred embodiment, as shown in FIG. 3, for example, there are two bogies comprising a front bogie 90 and a rear bogie 92. These bogies 90 and 92 have several common features. With reference to FIGS. 8–10, each of the bogies 90 and 92 has several sets of wheels for rolling engagement with a pair of spaced, parallel rails 88 positioned under the path or surface 18 on which the ride vehicle 10 travels. As explained below, these sets of wheels securely attach the bogies 90 and 92 to the rails 88. The front bogie 90 also is provided with two bus bar collectors 94 for each of six bus bars 95 of a power bus 97. These bus bar collectors 94 are spring-tensioned to maintain the necessary contact forces between the collector and the bus bars 95 to provide the A.C. electrical power used to drive the electric motor 32 and certain control system signals for the ride vehicle 10.

Each bogie 90 and 92 has a multiple wheel arrangement comprising load wheels 96, up-stop wheels 98, static guide wheels 100 and active guide wheels 102. The load wheels 96, of which there are four, ride on the top of the rails 88 and support the weight of the bogies 90 and 92. The up-stop wheels 98, which also are four in number, are located on the bottom of the bogies 90 and 92 and inhibit upward motion. These wheels 98 preferably are designed with a small clearance relative to the rails 88 so as not to add to the rolling resistance of the bogie 90 or 92. There are two static guide wheels 100 to prevent lateral motion of the bogie 90 or 92 into the side of the rail 88. Finally, two active guide wheels 102 mounted on pivoting arms 104 pre-load and center the bogie 90 or 92 and also inhibit lateral motion of the bogie into the side of the opposing rail 88. Each of these wheels 104 also is provided with a spring-tensioner 106 for the pre-loading and centering function.

The front bogie 90 is connected to the ride vehicle's front steering system and, therefore, is subjected to front steering loads. The rear bogie 92 is essentially free of normal operating loads, other than its own weight, and is towed along the path through its connection to the ride vehicle's lateral energy absorbing system, described below.

In the preferred embodiment, the bus bars 95 of the power bus 97 are aluminum and have a stainless steel wear surface and a 200 amp. capacity. For example, the Wampfler Model 812 bus bar has been used and found to be suitable. The collector (not shown) preferably has a wear surface comprising copper graphite. The bus bars 95 preferably are installed in an open downward position to prevent debris from entering the bars and shortening their life.

Figure 11:
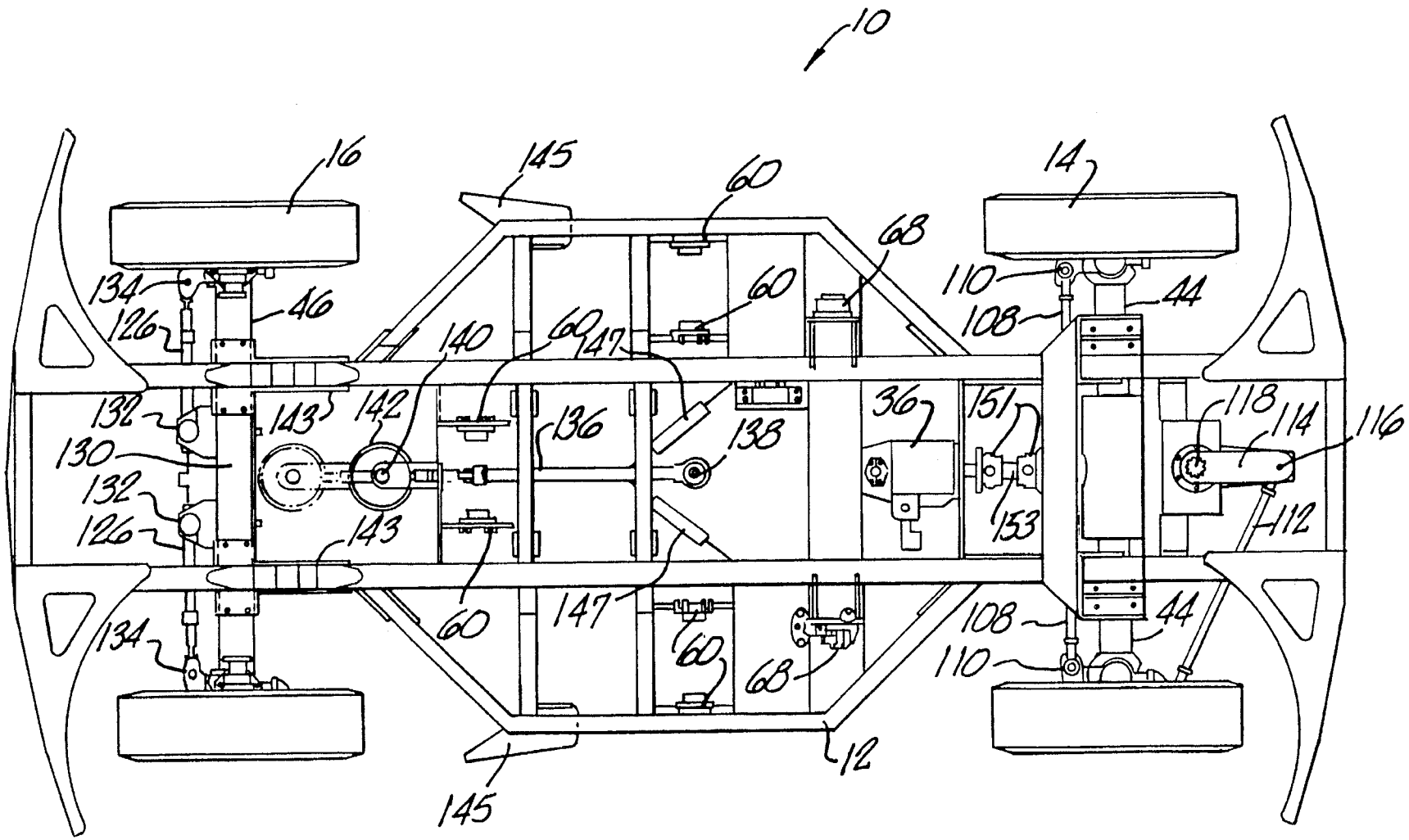
FIG. 11 is a top plan view of the ride vehicle chassis illustrating the steering mechanisms and a lateral energy absorbing system of the ride vehicle.
Figure 12:
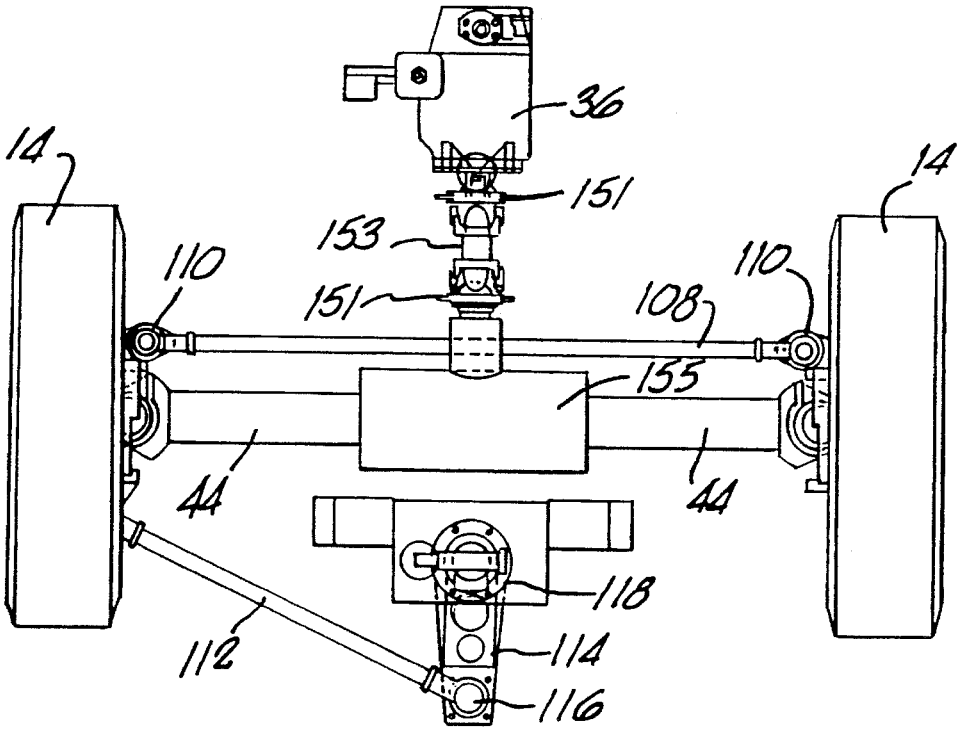
FIG. 12 is an enlarged top plan view of the front steering mechanism.
Figure 13:
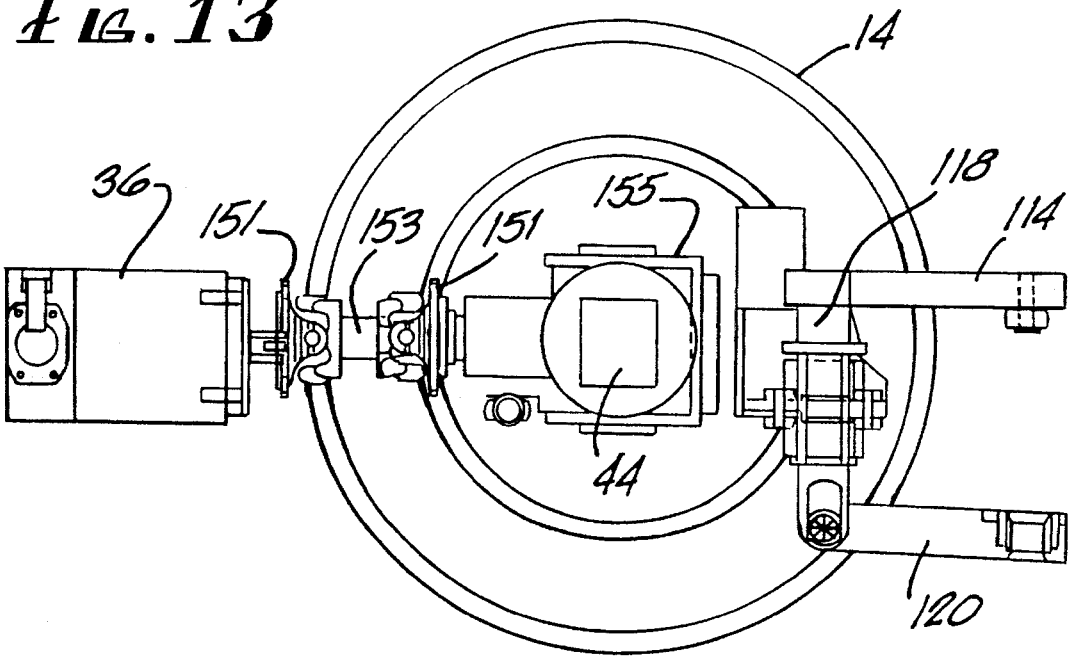
FIG. 13 is an enlarged side elevational view of a portion of the front steering mechanism shown in FIG. 12.

As shown best in FIGS. 11–13, the ride vehicle's front wheels 14 are steered via a mechanical steering system that uses the curvature of the path 18 to steer the front wheels. More particularly, the two front wheels 14 are connected to the ride vehicle chassis 12 for rotation by the front axles 44, using zero king pin inclination. The two front wheels 14 also are linked together by a linkage arm 108, such that turning motion of one front wheel 14 is automatically transferred via the linkage arm 108 to the other front wheel 14. The two ends of the linkage arm 108 are connected to the front wheels 14 by conventional ball and joint connections 110.

One of the front wheels 14, such as the right-front wheel, is connected by a steering bar 112 to an upper steer arm 114 via ball and joint connections 116. The upper steer arm 114 is connected by a vertical spline shaft 118 to a lower input arm 120 such that horizontal pivoting motion of the lower input arm 120 about the axis of the vertical spline shaft 118 is directly translated into corresponding horizontal pivotal movement of the upper steer arm 114. The lower end of the spline shaft 118 is pivotally connected to the lower input arm 120 to accommodate up and down movement of the lower input arm caused by the grade of the path 18. The lower input arm 120 is, in turn, bolted to the front bogie 90 via a front follower 122 and a plain spherical bearing 124.

With the foregoing front steering arrangement, it can be seen that steering of the front wheels 14 is governed by the curvature of the path 18. Thus, on a straight path 18, the front wheels 14 point straight ahead. However, when the front bogie 90 follows a turn in the path 18, causing non-linear movement of the front bogie, the lower input arm 120 is caused to pivot with respect to the bogie 90 via the plain spherical bearing 124. This pivoting motion of the lower input arm 120 is transferred via the spline shaft 118 to the upper steer arm 114 which, in turn, moves the steering bar 112 causing the right-front wheel 14 to turn in the direction of the turn. This turning motion of the right-front wheel 14 is transferred via the linkage arm 108 to the left-front wheel 14 to provide coordinated steering of the two front wheels in unison.

Figure 14:
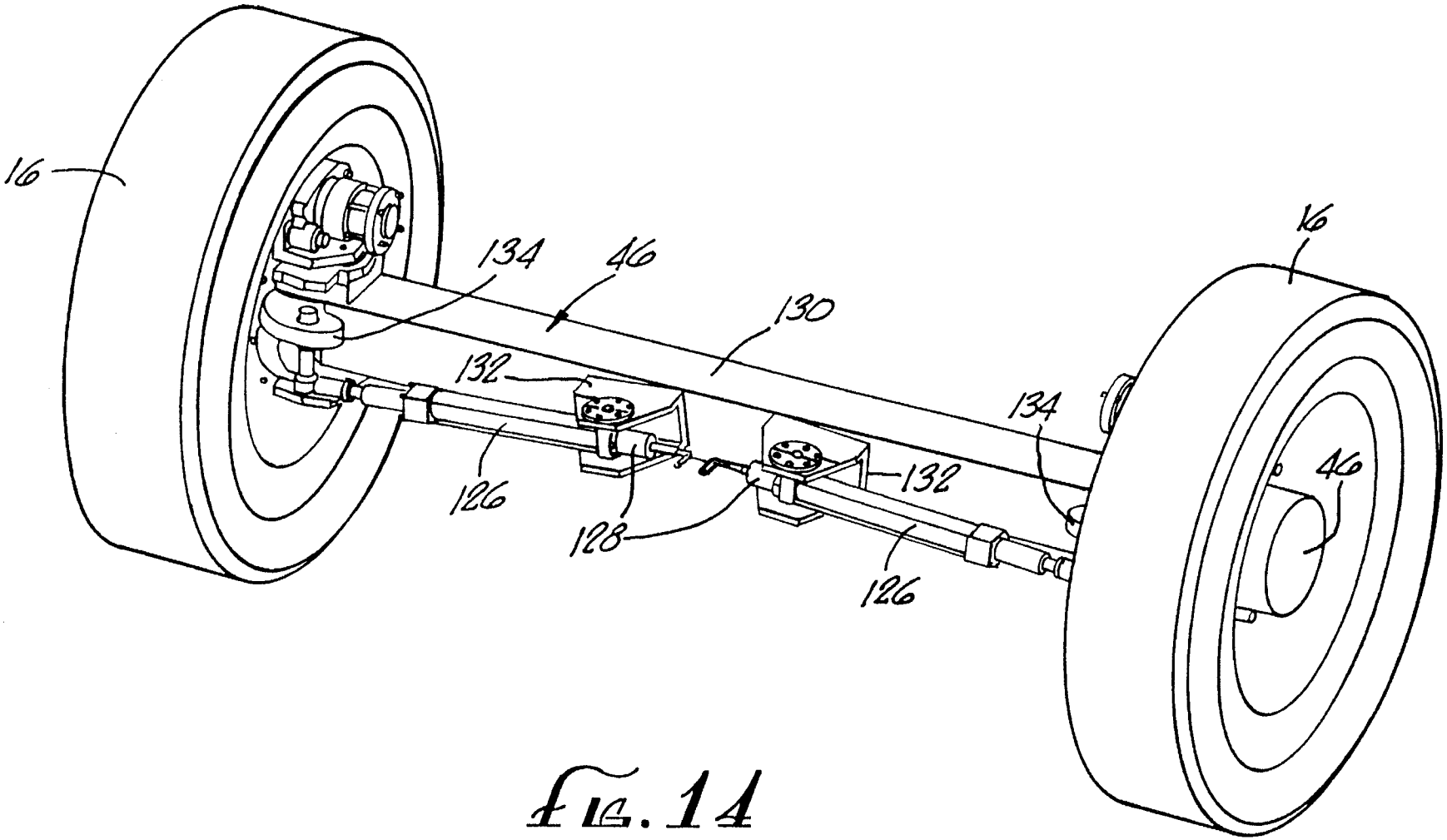
FIG. 14 is a rear perspective view of the essential details of the rear steering mechanism.
Figure 15:
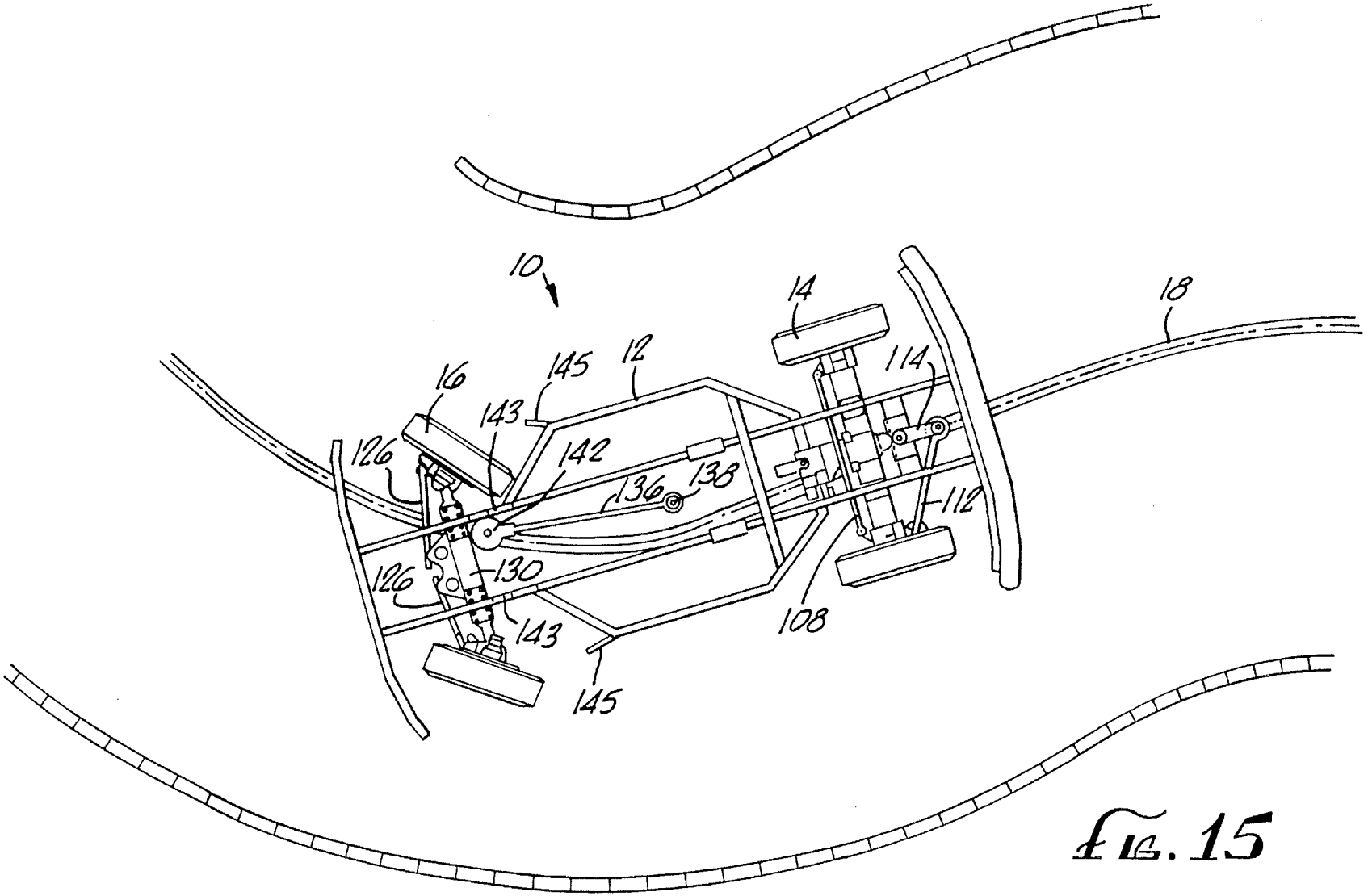
FIG. 15 is a cross-sectional plan view of the ride vehicle illustrating the lateral energy absorbing system operating in a first mode to confine the range of lateral motion of the vehicle with respect to the track to a first distance.
Figure 16:
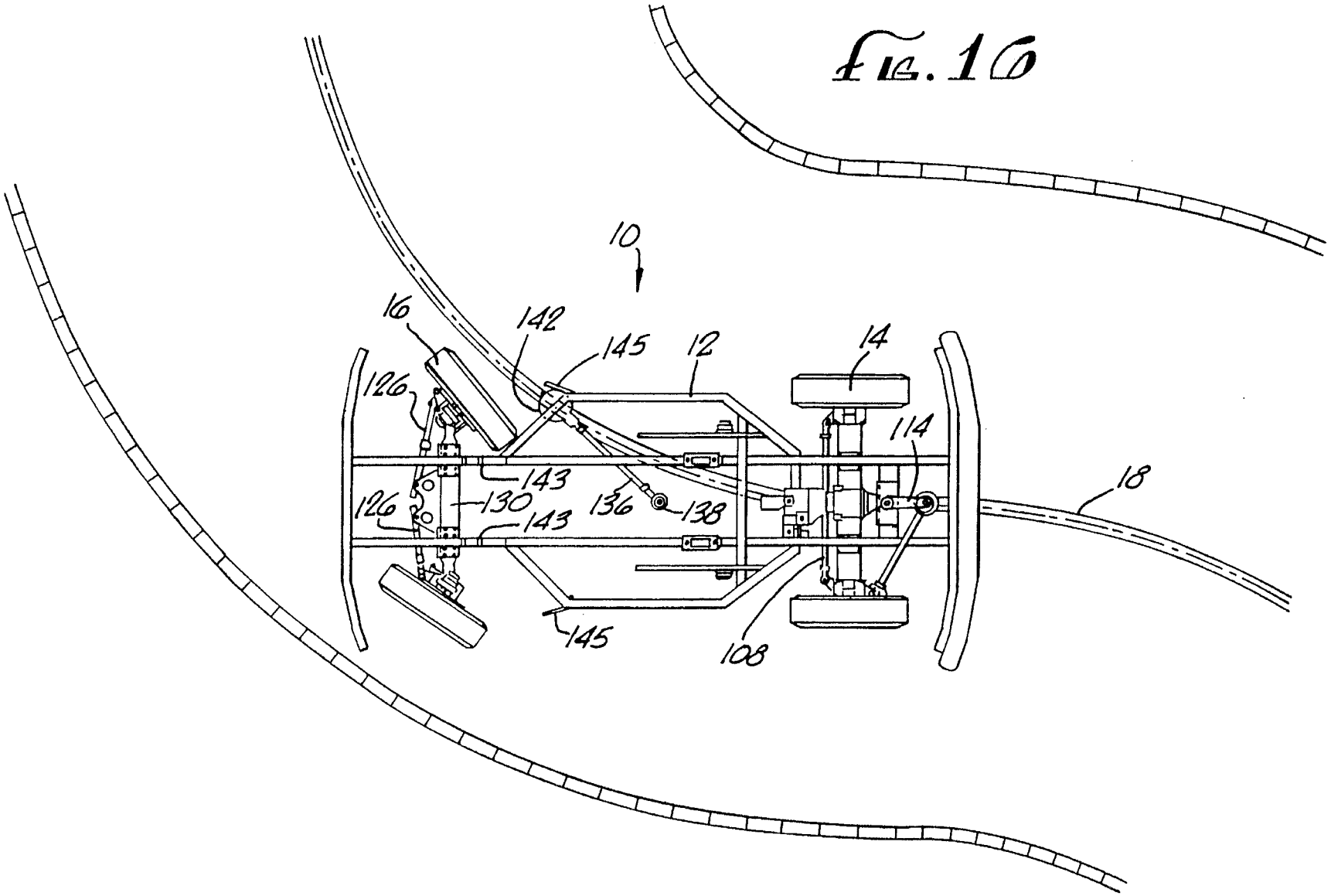
FIG. 16 is another cross-sectional plan view of the ride vehicle illustrating the lateral energy absorbing system operating in a second mode to confine the range of lateral motion of the vehicle with respect to the track to a second distance.

In one aspect of the configuration of the preferred ride vehicle, steering of the rear wheels 16 is independent of steering of the front wheels 14 to increase the versatility of motion of the ride vehicle 10. As shown in more detail in FIGS. 11 and 14, the steering of each rear wheel 16 is controlled by separate hydraulic steering servo actuators 126. These steering actuators 126 are connected to the hydraulic control system of the ride vehicle 10 and are controlled by the ride vehicle control system in combination with feedback signals from sensors 128 to control the movement of the actuators 126 and, thus, the steering of the rear wheels 16. FIGS. 15 and 16 show the range of steering motion of rear wheels 16 in more detail.

In particular, the inner ends of the steering actuators 126 are mounted to the ride vehicle's rear axle beam 130 by brackets 132 with pivotal connections 133. The outer ends 135 of the steering actuators 126 are mounted to trunion mountings 134 at the rear axle 46 via plain bearings. The trunion mounting 134 for the actuators 126 incorporates motion in two axes to allow for build tolerances. The steering actuators 126 are controlled by the hydraulic control system through appropriate valving and tubing.

The foregoing arrangement, which provides independent steering of the front wheels 14 and the rear wheels 16, allows a wide range of ride vehicle motion not otherwise possible with conventional ride vehicles, which have either had front wheel steering or rear wheel steering (but not both), or no steering capabilities at all for ride vehicles that are totally path dedicated. The examples of ride vehicle motion enabled by four-wheel steering include the simulated effect of the ride vehicle 10 fishtailing, such as during rapid acceleration or deceleration of the ride vehicle, or sliding sideways as on ice or an oil slick. The turning of corners can also be exaggerated by using four-wheel steering, which substantially enhances the general overall mobility and turning capabilities of the ride vehicle 10.

FIG. 11 also illustrates a special lateral energy absorbing system of the vehicle. With reference also to FIGS. 15 and 16, the lateral energy absorbing system is adapted to allow the vehicle 10 to move laterally with respect to the rear bogie 92 within a pre-determined tracking envelope boundary during movement of the vehicle 10 along the path 18. The lateral energy absorbing system comprises a rear follower lockout actuator 136 pivotally connected to the vehicle chassis 12 by a pivot shaft 138 and to the rear bogie 92 via a spherical bearing 140 on a rear follower 142. The lockout actuator 136 is designed to preferably operate in two distinct modes related to the vehicle's path 18. The lockout actuator 136 is designed to preferably operate in a first mode when the vehicle 10 may move within a large envelope, as shown in FIG. 16. In the first mode, the lockout actuator 136 is in a retracted position. In this retracted position, an energy absorbing pad 142 at the rear portion of the actuator 136 is laterally confined between two vertical plates 143 spaced apart by a first distance on the vehicle chassis 12.

The lockout actuator 136 is designed to operate in the second mode when the vehicle 10 follows a path 18 within a confined space, when it is desired that lateral offset from the center of the path be restricted, such as illustrated in FIG. 15. In the second mode, the lockout actuator 136 is in a fully-extended position. In this fully-extended position, the energy absorbing pad 142 at the rear portion of the lockout actuator 136 is laterally confined between two oppositely facing vertical blades 145 on the vehicle chassis 12 which are spaced apart by a second distance that is smaller than the first distance previously described.

In the event that the vehicle chassis 12 attempts to move laterally with respect to the rear bogie 92 by an amount that exceeds the distance (when the lockout actuator 136 is extended in the first mode, as shown in FIG. 15, or when the lockout actuator 136 is fully retracted in the second mode, as shown in FIG. 16), then the energy absorbing pad 142 will contact either the vertical plates 143 or the vertical blades 145 on the vehicle chassis 12 to prevent further lateral movement. Moreover, when the lateral movement of the vehicle chassis 12 attempts to exceed the first distance, when the lockout actuator 136 is fully extended in the first mode, or when the lateral movement of the vehicle chassis 12 attempts to exceed the second distance, when the lockout actuator 136 is fully retracted in the second mode, a sensor 147 coupled to the lockout actuator 136 will be activated to cause an E-stop and completely disable the vehicle 10.

With reference to FIG. 11, two sensors 147 are designed to measure the amount of lateral travel of the energy absorbing pad 142 by sensing the amount of rotation of the pivot shaft 138 which connects the front end of the lockout actuator 136 to the vehicle chassis 12. Each of the two sensors 147 is a piston-type linear sensor that either extends or retracts when the energy absorbing pad 142 moves laterally, thereby causing rotation of the pivot shaft 138. Under appropriate operating conditions and proper programming of the ride vehicle 10, the lateral motion of the vehicle with respect to the rear bogie 92 is designed such that the energy absorbing pad 142 will not completely travel either the first or second distance and will avoid contacting one of the vertical plates 143 or blades 145. Instead, the energy absorbing pad 142 will stop just short of the plates 143 or blades 145 under a maximum travel condition (i.e., the tracking envelope boundary). However, should the energy absorbing pad 142 attempt to exceed the tracking envelope boundary, the sensors 147 will cause the E-stop and completely disable the vehicle 10. The lockout actuator 136 is moved to the extended and retracted positions by the hydraulic control system based on commands provided by the computerized vehicle-control system 40.

The Hydraulic Control System

Figure 17:
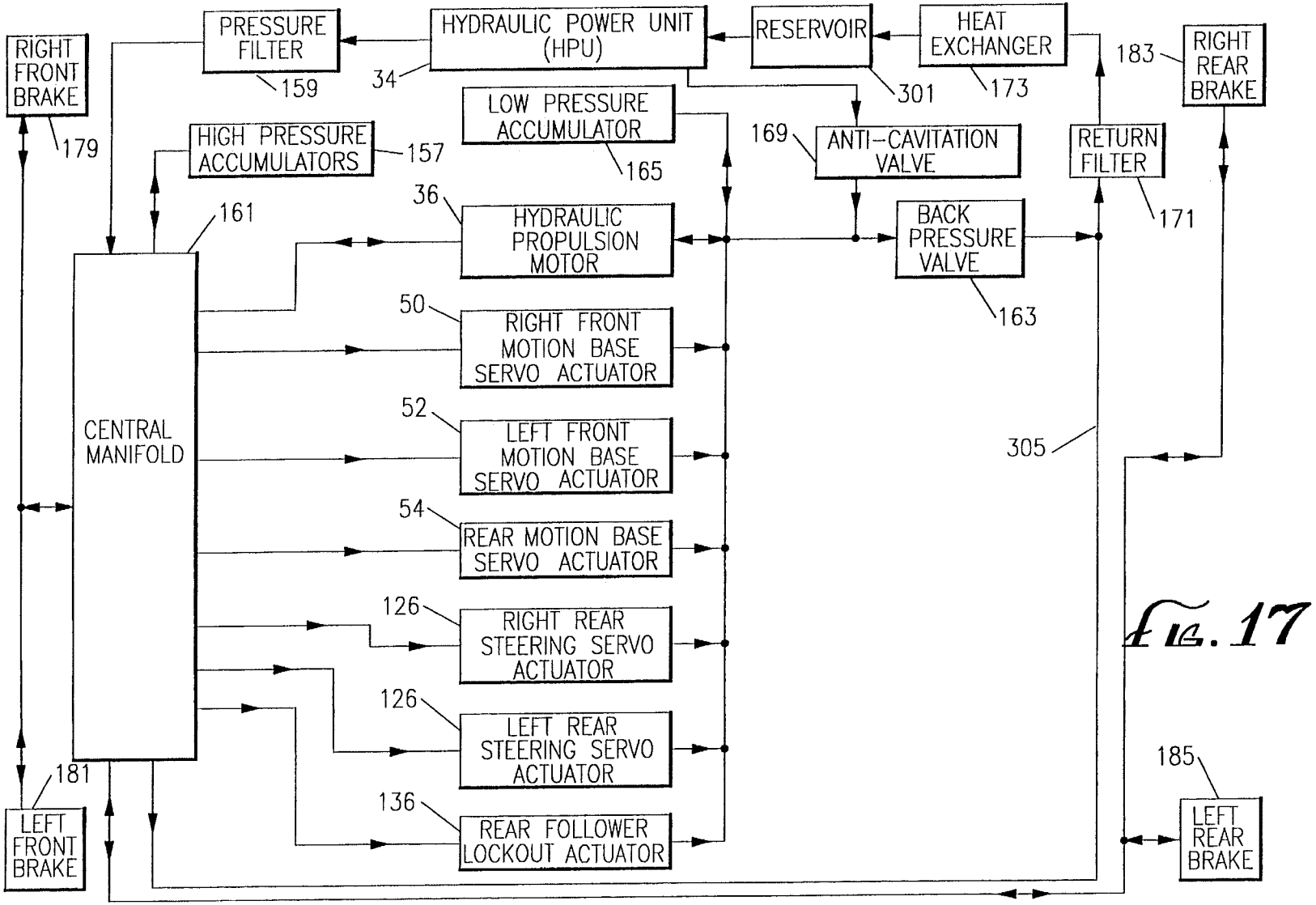
FIG. 17 is a block diagram of the hydraulic system used to operate the motion apparatus, rear steering mechanism and other components of the vehicle.

FIG. 17 is a block diagram illustrating the hydraulic control system for providing hydraulic power to the various actuators and other components of the ride vehicle 10. A three-phase, 480 volt power supply, tapped from the power bus 97, drives the electric motor 32, which in turn drives the hydraulic power unit 34. The hydraulic power unit 34 is responsible for providing the energy for all of the ride vehicle's actuators, and operating the hydraulic motor 36. As shown in FIG. 12, the output of the hydraulic motor 36 is transferred by couplings 151 to a differential ratio gear box 155. Differential and planetary gears inside the gear box 155 create a 20:1 ratio for driving the front wheels 14. In the preferred embodiment, the hydraulic motor 36 is a 125 cubic centimeter variable displacement hydraulic motor (manufactured by the Rexroth Corporation, of Bethlehem, Penn.) and is mounted to the ride vehicle chassis 12. A tachometer (not shown) measures the motor's output shaft rotations-per-minute. This information is sent as a signal input to the computerized vehicle-control system 40, which monitors an overspeed condition of the motor, while stroke displacement transducers (also not shown) measure hydraulic displacement of the hydraulic motor's pistons to provide for controlled acceleration, deceleration and velocity of the ride vehicle 10. Using a nested control loop in software to monitor this arrangement, the ride vehicle 10 travels at speeds of up to about 15 miles per hour.

An important function of the hydraulic power unit 34 is to charge the high-pressure accumulators 157 with hydraulic energy. FIG. 3 shows the location of these accumulators 157 at the rear of the ride vehicle. These accumulators are used for ride vehicle propulsion, actuation of the motion base 24 and for steering of the rear wheels 16. The hydraulic power unit 34 supplies this hydraulic energy by pumping hydraulic fluid through a pressure filter 159 through a central manifold 161 and subsequently to the high-pressure accumulators 157. The primary function of the high-pressure accumulators 157 is to store and save energy for supply on demand to the various energy users of the hydraulic system. These energy users comprise the hydraulic motor 36, the leftfront motion base servo actuator 50, the right-front motion base servo actuator 52, the rear motion base servo actuator 54, the right-rear steering servo actuator 126, the left-rear steering servo actuator 126 and the rear follower lockout actuator 136. Each of these actuators, except for the follower lockout actuator 136, has a servo valve which controls the flow of pressurized hydraulic fluid to the actuators according to a command from the computerized vehicle-control system 40.

The hydraulic control system also includes a back pressure valve 163 that maintains a predetermined amount of back pressure in a low-pressure accumulator 165. In the preferred embodiment, the back pressure valve 163 has a one-hundred and thirty-five pounds-per-square-inch gauge ("psig") setting. The low-pressure accumulator 165 is designed to store extra hydraulic fluid that may be needed by the hydraulic propulsion motor 36 when the ride vehicle 10 is decelerating, to thereby provide regenerative braking, as will be explained below.

An anti-cavitation valve 169, a return filter 171 and a heat exchanger 173 also are provided to complete the hydraulic control system. The anti-cavitation valve 169 prevents damage to the hydraulic propulsion motor 36 in the event that the low-pressure accumulator 165 is completely depleted of hydraulic fluid. Under these circumstances, the anti-cavitation valve 169 supplies hydraulic fluid under atmospheric pressure to the hydraulic propulsion motor 36 to prevent it from cavitation damage. The return filter 171 filters the returning hydraulic fluid, and the heat exchanger 173 cools the fluid before it is returned to a reservoir 301.

In addition to the heat exchanger 173, cooling of the hydraulic fluid also is provided by a cooling fan 175 driven by an output shaft of the electric motor 32. The cooling fan 175 is designed to run whenever the hydraulic system is powered. The fan 175 includes a shroud 177 that directs airflow through the heat exchanger 173 and over the electric motor 32. The shroud 177 also encloses the electric motor 32, hydraulic pump 34 and cooling fan 175. The return filter 171 is used to keep debris out of the hydraulic fluid before it enters the heat exchanger 173.

The hydraulic control system also is used to control operation of the ride vehicle's emergency brakes. These brakes comprise a right-front brake 179, a left-front brake 181, a right-rear brake 183 and a left-rear brake 185. In the preferred embodiment, the ride vehicle's brakes 179, 181, 183 and 185 are spring applied disc brakes of the failsafe type. The hydraulic system for the brakes involves a bi-directional hydraulic fluid flow. To apply the brakes 179, 181, 183, and 185, hydraulic fluid is withdrawn from the brakes through a return line to the central manifold 161 and return filter 171. This releases the brake springs and applies spring force to cause braking action. To release the brakes 179, 181, 183 and 185, pressurized hydraulic fluid is supplied to the brakes to compress the springs and remove the spring force. The emergency brakes are used primarily during an emergency stop, or during passenger unloading and unloading, to thereby "park" the ride vehicle. During movement of the ride vehicle 10 in accordance with one of the ride programs, however, dynamic braking of the ride vehicle using the hydraulic motor 36 is preferred means of braking vehicle motion.

The hydraulic control system includes several special features. In one aspect of the hydraulic control system, illustrated diagrammatically in FIGS. 18A and 185, the hydraulic motor 36 is designed to recover kinetic energy that is created when the ride vehicle 10 is braking or decelerating.

Figure 18A:
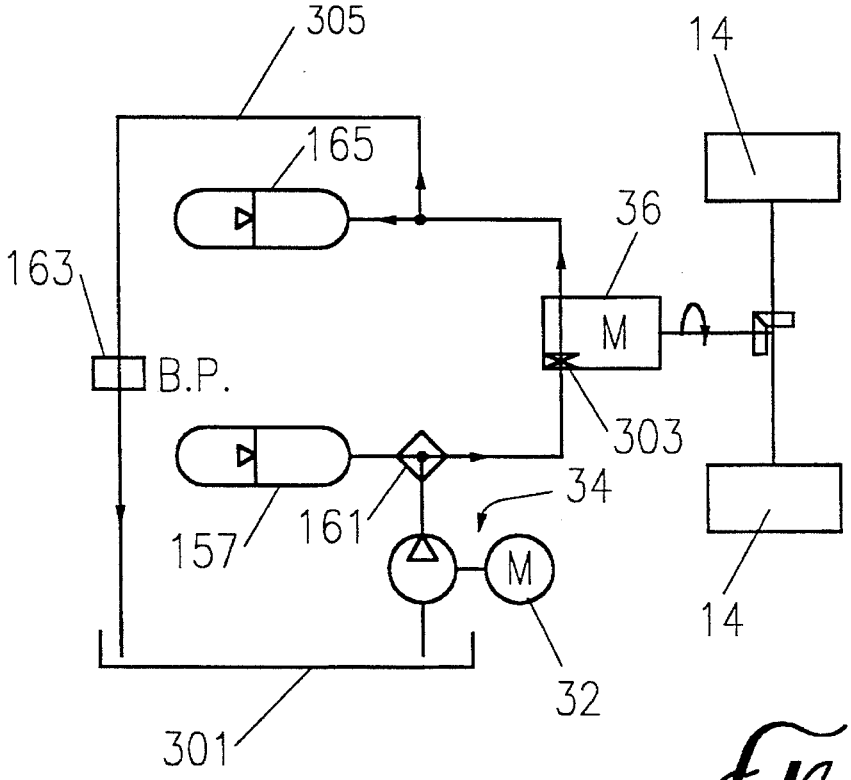
FIG. 18A is a functional diagram showing elements of the preferred hydraulic propulsion system where pressurized hydraulic fluid supplies hydraulic energy to a hydraulic motor, which drives the ride vehicle. The spent hydraulic fluid pressurizes a low-pressure accumulator, with excess hydraulic fluid returned to a hydraulic fluid reservoir.

As noted above, pressurized hydraulic fluid flows from the high-pressure accumulators 157, through the hydraulic motor 36 to propel the ride vehicle 10, and then into the low-pressure accumulator 165 when the ride vehicle is accelerated (according to ride program data from a sequence of data). The motor speed is controlled according to a predetermined vehicle speed profile, defined by a sequence of data of a particular ride program. Each particular piece of data represents vehicle speed at a particular position (defined in the preferred embodiment according to one of distance and time), and a software loop adjusts the angle of a swashplate via a control valve 303 to allow appropriate displacement of the hydraulic motor 36 to match vehicle speed and the hydraulic energy presently stored in the high-pressure accumulators 157 (which is at approximately 3500 psig pressure). As shown in FIG. 18A, spent hydraulic fluid pressurizes the low-pressure accumulator 165 to approximately 135 psig, and additional hydraulic fluid is dumped through the back pressure valve 163 through a return line 305 to the reservoir 301.

Figure 18B:
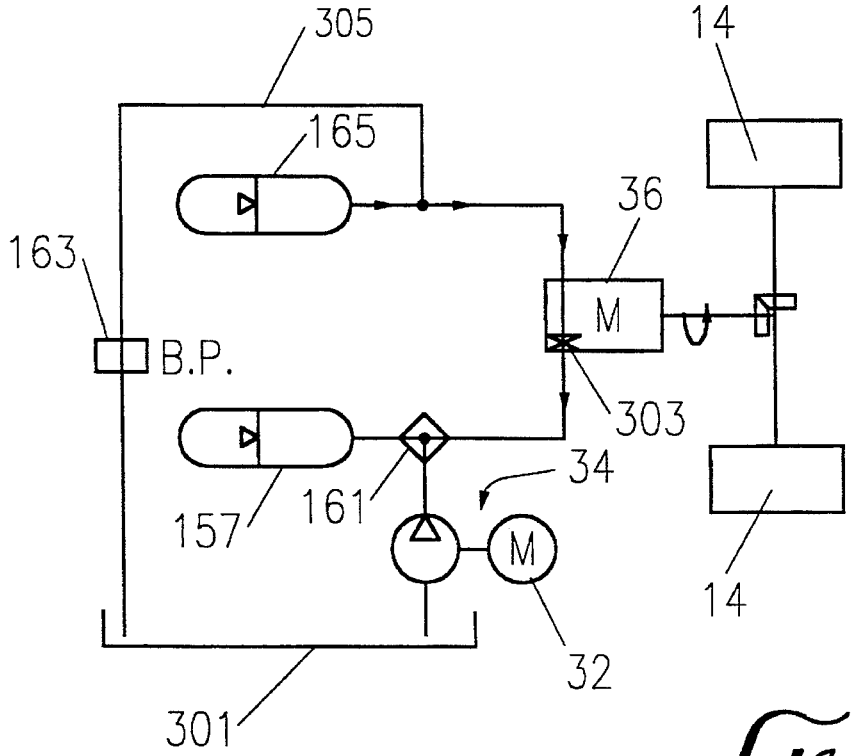
FIG. 18B is similar to the functional diagram of FIG. 18A, but shows the elements of FIG. 18A which are used for regenerative braking, where a negative swashplate angle of the hydraulic motor causes the vehicle's kinetic energy to pump and pressurize hydraulic fluid from the low-pressure accumulator, to thereby increase the amount of stored hydraulic energy stored in a high-pressure accumulator, and to provide for one hundred percent dynamic braking.

The swashplate angle, although driven to a positive angle when the vehicle is called upon to accelerate or maintain a velocity, is generally driven to a negative angle when the vehicle is called upon to decelerate. In this case, illustrated by FIG. 18B, the hydraulic motor 36 provides resistance to continued vehicle motion, and the kinetic energy of the ride vehicle 10 causes the motor to pump hydraulic fluid from the low-pressure accumulator into the high-pressure accumulators 157, to thereby transfer the kinetic energy of the ride vehicle 10 to hydraulic energy stored in the high-pressure accumulators.

The recovered energy is thus stored in the high-pressure accumulators 157 for future use by any of the hydraulic control system's other energy users, such as the motion base servo actuators 50, 52 and 54, the steering actuators 126, or the hydraulic motor 36. The energy stored in the high-pressure accumulators 157 can be especially useful when it is necessary to execute rapid and continuous movements with the motion base servo actuators 50, 52 and 54 requiring a high-horsepower output.

By recovering energy during braking and decelerating and storing it in the high-pressure accumulators 157, the hydraulic motor 36 essentially functions as a pump and allows the system to store and subsequently provide higher peak output horsepower upon demand than would otherwise be obtainable from a conventional hydraulic power unit and control system. As a result, a relatively smaller horsepower hydraulic power unit 34, on the order of about 50 horsepower, may be used. However, in view of the ability of the system to store large volumes of hydraulic energy, the system can still provide peak horsepower outputs that far exceed the horsepower of the hydraulic power unit 34, by a factor of three or more.

Figure 19:
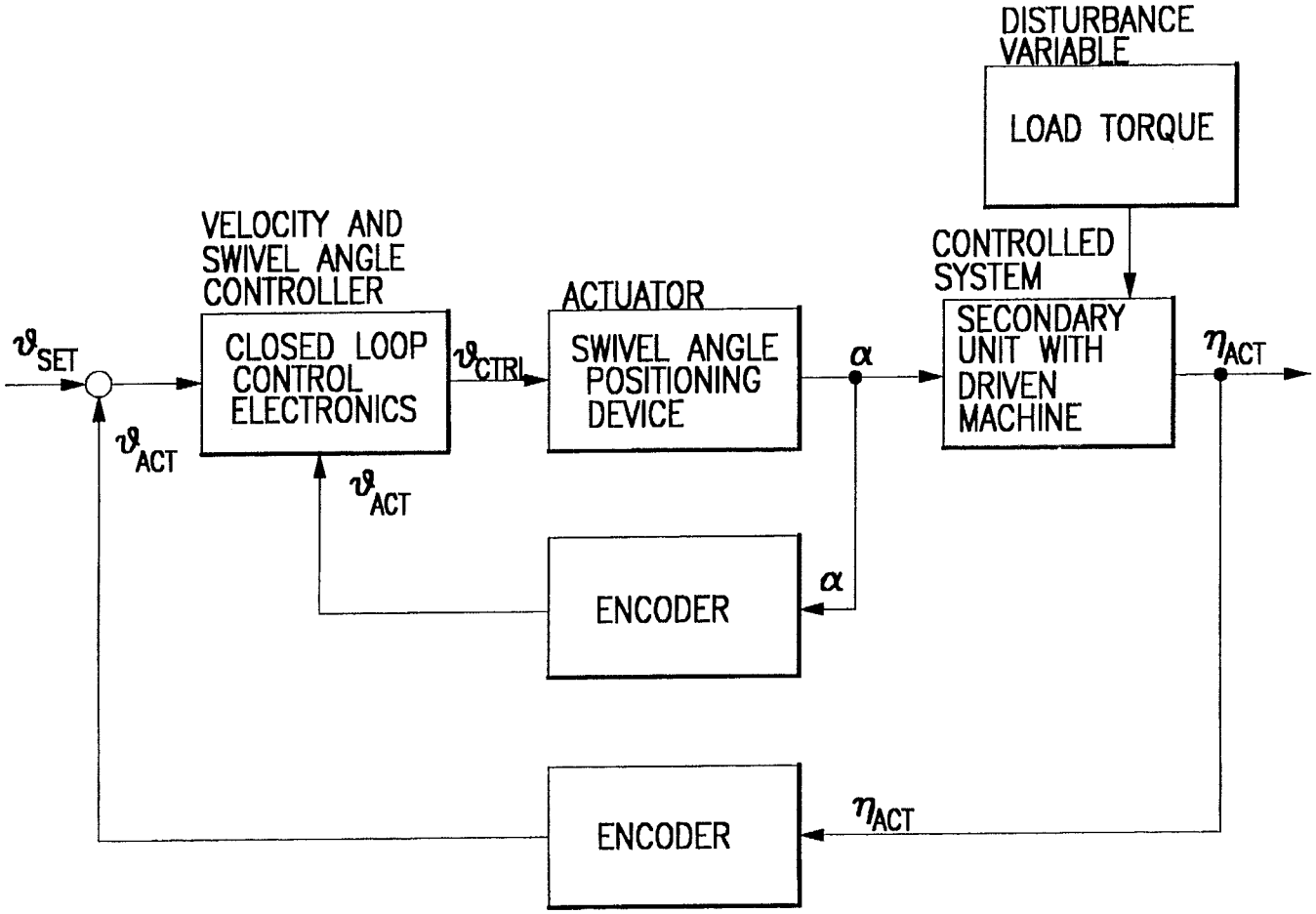
FIG. 19 is a functional block diagram of the feedback control of the hydraulic motor and ride vehicle velocity, showing a combination of hardware and software in nested control loops.

FIG. 19 is a functional block diagram that illustrates control over the motor achieved by a combination of mechanical, electronic and software elements. As explained further below in connection with the computerized vehicle-control system 40, speed of the ride vehicle 10 is controlled using two control loops, an inner loop and an outer loop. The inner loop controls the position of the swashplate (hydraulic motor) in response to its commanded position to obtain a desired output torque. The outer loop controls the commanded swashplate angle to control actual vehicle velocity with respect to commanded vehicle velocity, compensating for dynamic errors, including steep hills and other disturbance variables such as wheel slip, rolling (tire) radius errors, etc., and provides a correction signal to the inner loop.

Figure 20:
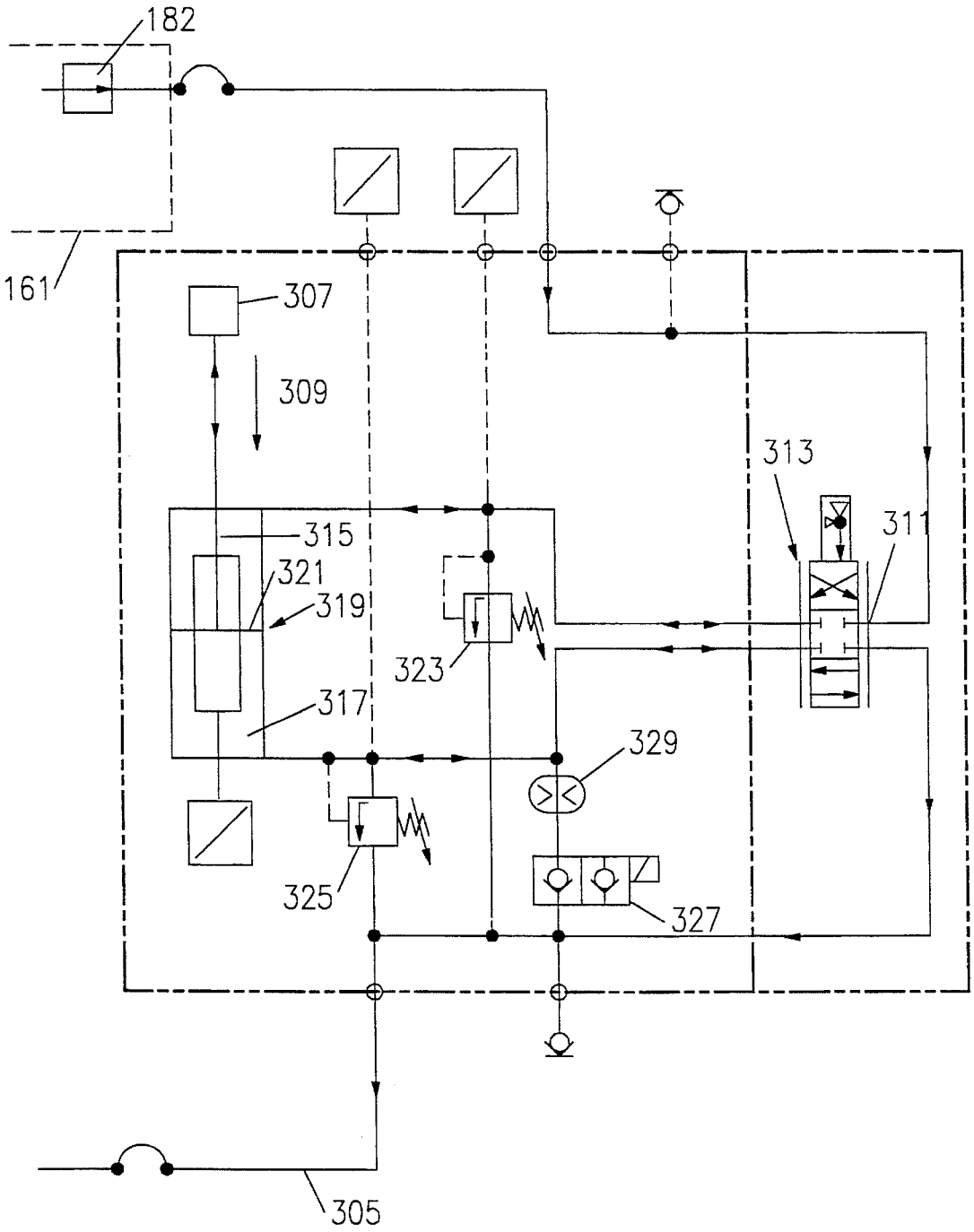
FIG. 20 is a hydraulic schematic diagram illustrating one of the three motion base servo actuators that articulate the passenger holding structure.

In another aspect of the hydraulic control system, the functions of blocking and settling valves to control the flow of hydraulic fluid to the motion base servo actuators 50, 52 and 54 are made separate and distinct. Thus, instead of using a blocking and settling valve on each motion base servo actuator 50, 52 and 54, a single blocking valve 182 is used to control the flow of hydraulic fluid to all of these actuators. A separate settling valve also is provided for each of these three actuators, as illustrated in FIG. 20, which is a hydraulic schematic diagram that corresponds to each of the three motion base servo actuators. The foregoing arrangement of using a single blocking valve 182, as opposed to three separate blocking valves, enables accurate and coordinated control of the actuators 50, 52 and 54 in the event that the motion base 24 is disabled.

As shown in FIG. 20, each motion base servo actuator 50, 52 and 54 is vertically erect, supporting a load 307 having a weight in a direction indicated by the reference arrow 309. Each actuator 50, 52 and 54 includes a high-pressure coupling 311, by which hydraulic energy is provided from the manifold 161 and blocking valve 182, which is normally-closed and motivated open by the presence of an electric control signal. Thus, in the event of a power failure, the blocking valve 182 is automatically closed to block the further supply of hydraulic fluid to the actuators 50, 52 and 54.

A servo valve 313 receives hydraulic energy via the high-pressure coupling 311, and is electronically controlled to supply varying amounts of hydraulic energy (up to 3200 psig) to each of first and second fluid chambers 315 and 317 of a cylinder 319 of the actuator 50, 52 and 54, to precisely control the stroke of a piston 321 to articulate the passenger holding structure 20. The servo valve 313 further includes a low-pressure coupling, by which hydraulic fluid may be discharged to the return line 305, and an electronic control signal input (not shown) from the computerized vehicle-control system 40. Relief valves 323 and 325 are also provided, which allow the venting of excess pressure above 3200 psig and the return of hydraulic fluid via the return line 305 to the reservoir 301.

The settling valve 327 of each actuator 50, 52 and 54 is also shown in FIG. 20, and couples the second chamber 317 of the cylinder 319 to the return line 305. Each settling valve 327 is normally-open, such that in the event of loss of power, the weight of gravity 309 of the passenger holding structure 20 and body 22 (on the order of several tons) will force the piston 321 to retract the second fluid chamber 317 and expel the hydraulic fluid from that chamber through the settling valve to the return line 305, and ultimately, to the reservoir 301. A special orifice 329 is provided to limit the rate at which hydraulic fluid can flow through the settling valve 327, to thereby limit the rate of settling of the motion base 24.

Figure 21A:
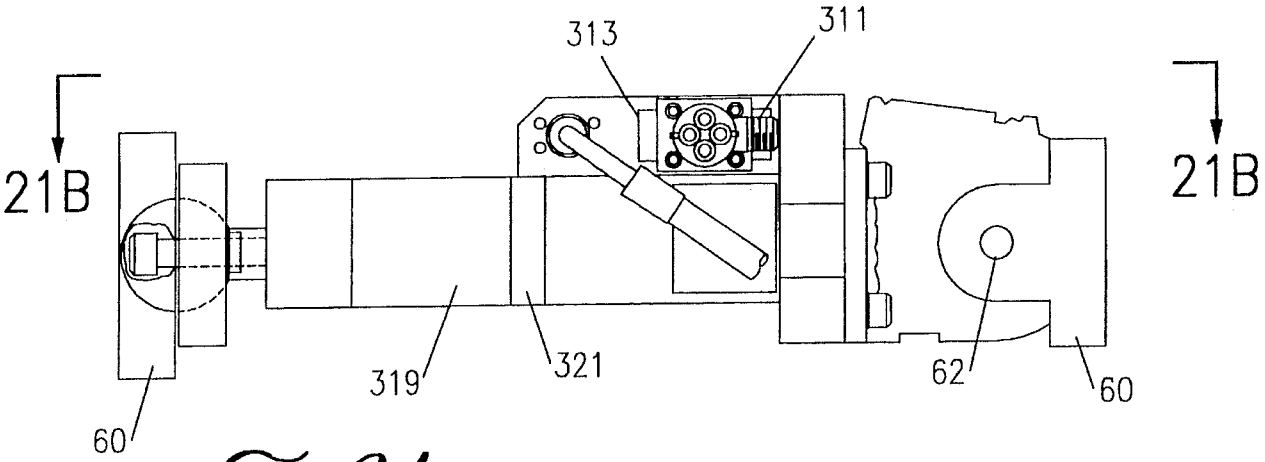
FIG. 21A is a side view of one of the motion base servo actuators.
Figure 21B:
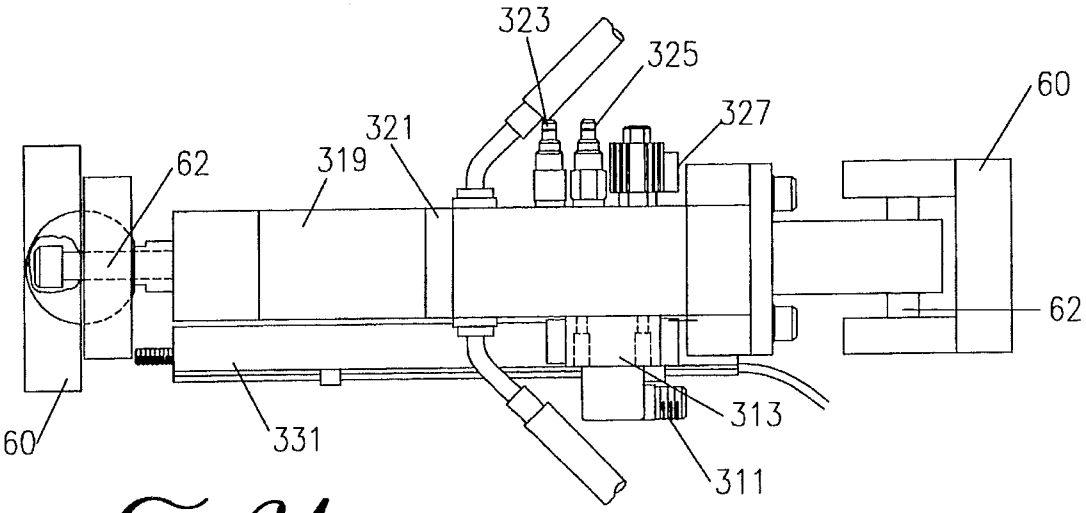
FIG. 21B is another side view of the actuator of FIG. 21A, taken along line B—B of FIG. 21A.

The configuration of the motion base servo actuators 50, 52 and 54 is illustrated in FIGS. 21A and 21B. Each actuator provides a ten-inch stroke of the piston 321 with respect to the cylinder 319, and includes a Linear Variable Differential Transformer ("LVDT") sensor 331 that provides a feedback signal to the computerized vehicle-control system 40, to enable feedback control over actuator displacement.

A single blocking valve 184 and 186 also is provided for the rear steering servo actuators 126, and separately for the hydraulic motor 36, respectively, which do not use any settling valves. The blocking valve 186 for the hydraulic motor 36 isolates this motor from the high-pressure accumulators 157. When this blocking valve 186 is opened, the deceleration of the ride vehicle 10 will charge these accumulators, and when closed, one hundred percent dynamic braking torque will be generated.

All of the blocking valves 182, 184 and 186 described above preferably are incorporated inside the central manifold 161. All of these blocking valves, when opened, function as slow-shifting, moderating type valves to allow relatively slow movement of the system's actuators when opening. This prevents sudden movements of these actuators and associated undesired and uncontrolled movement.

As mentioned, the blocking valve 186 on the hydraulic motor 36 also permits one hundred percent dynamic braking torque when the ride vehicle 10 is decelerating and when the blocking valve is closed. During braking, the hydraulic motor 36 acts as a pump to pressurize the high-pressure accumulators 157, as monitored by the computerized vehicle-control system. However, when the pressure in the high-pressure accumulators 157 is too low, or when large dynamic braking torque is required, the blocking valve 186 on the hydraulic motor 36 may be closed and increases the resistance provided to the pumping of hydraulic fluid toward the high-pressure accumulators by the hydraulic motor. Consequently, closing of the blocking valve permits one hundred percent dynamic braking capabilities. To this effect, a relief valve (not shown) located in the central manifold 161 is set at approximately 3,500 psi. In the preferred embodiment, a hydraulic motor 36 having 6,000 maximum psi is used. Therefore, if the relief valve is set at 6,000 psi, approximately two hundred percent braking torque could be achieved. It will be understood that various other amounts of braking torque can be provided by appropriate adjustment of the relief valve.

Figure 22A:
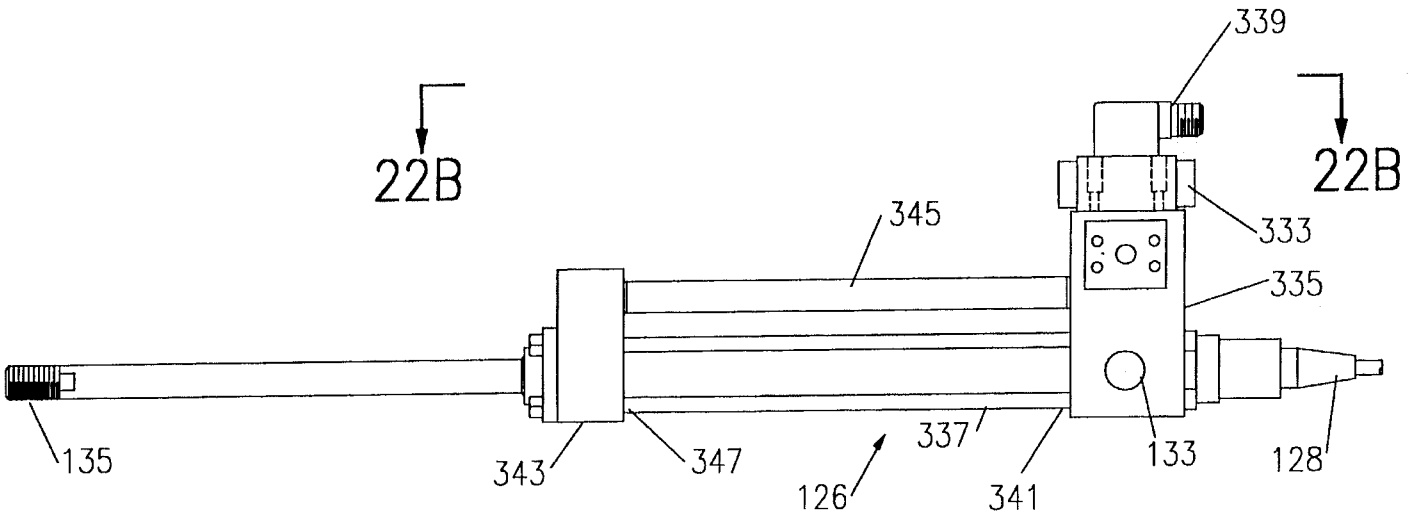
FIG. 22A is a side view of a rear wheel steering actuator, used to steer the ride vehicle along the path, within an envelope.
Figure 22B:
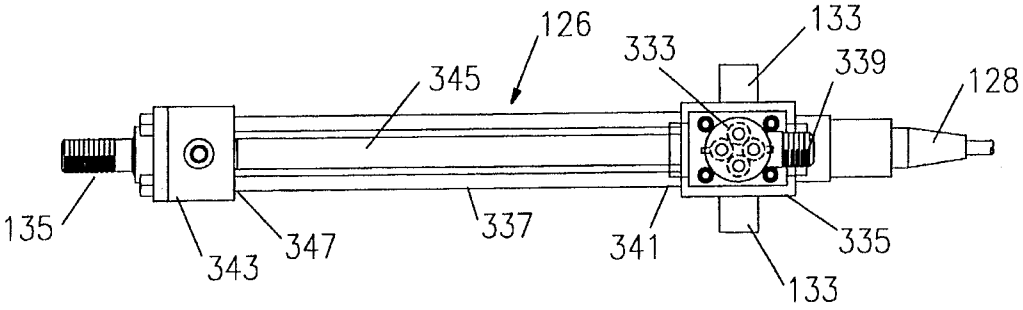
FIG. 22B is another side view of the actuator of FIG. 22A, taken along line B—B of FIG. 22A, and showing the actuator fully retracted.

FIG. 22B shows the configuration of the rear wheel steering actuators 126. Each actuator 126 includes a servo valve 333, mounted vertically above a first end 335 of a cylinder 337 of the actuator, and a high-pressure coupling 339 that permits the supply of hydraulic energy from the blocking valve 184 of the manifold 161. The servo valve 333 permits the supply of hydraulic energy to stroke a piston away from a first fluid chamber 341, toward a second opposing end 343 of the cylinder 337, and via hydraulic line 345 to a second fluid chamber 347 at the opposing end of the cylinder. The software control of the rear steering actuators 126 uses a feedback signal from a magnetostrictive-type sensor 128 to precisely control vehicle steering along the path, within a predefined envelope. Details of the feedback control are discussed further below, in connection with the description of the electronic control system.

The Electronic Control System

Control over the path 18 and all ride vehicles 10 currently running on the system is achieved by a central controller, called the "Wayside Interface" in the preferred embodiment. This Wayside Interface is at least partially located in a "Wayside Station," where passengers embark and disembark, and where a human operator can control the operation of the entire attraction. The Wayside Interface uses the power bus 97, comprised of six bus bars 95 (FIG. 11), to control ride vehicle power by path segment, or zone, and also radio (rf) communication to interact with computerized vehicle-control system 40 on each ride vehicle 10.

The computerized vehicle-control system aboard each ride vehicle 10 includes two vehicle computers that are responsible for conducting the ride experience in a programmable manner, and accordingly, the ride experience may be distinct for each ride vehicle 10. Programming and maintenance are effected by a special programming console, assisted by use of an off-line editor.

As shown in FIGS. 9 and 10, the power bus 97 is comprised of six adjacent bus bars 95, three just left of the center of the path 18 and three just to the right of the center of the path. The left three bus bars 95 supply four hundred eighty volts in three phases, one voltage phase carried by each bus bar, for meeting each ride vehicle's power requirements. Most aspects of ride vehicle control, including propulsion, are achieved by hydraulic power, which is derived from the hydraulic power unit 34, essentially a large electric pump. In addition, the power bus 97 supplies electric power that drives each ride vehicle's other electric elements, for example, a pneumatic compressor motor (not shown), and peripherals, including headlights 187 and the sound module 41. The three bus bars 94 just right of center provide a ground signal, a twenty-four volt go signal and a twenty-four volt, variable-impedance, "no-go" signal (which indicates the presence of a ride vehicle), the latter two signals being specific to each zone, or path segment. That is, in cases of emergency, the central controller can lower the go signal for each specific zone or all zones to disable forward motion of the ride vehicle 10 along the path.

Each ride vehicle 10 when operating, and in response to the go signal, places a voltage upon the "no-go" bus bar, which indicates to the Wayside Interface that a first ride vehicle is present in the particular zone. If a second ride vehicle becomes too close in spacing along the path 18 to the first vehicle, the central controller detects the presence of two ride vehicles in adjacent zones and disables the go signal to the zone of the second vehicle, until the first vehicle has left the zone that it occupies. During use of these two bus bars 95 (go and no-go), power is continuously supplied to the ride vehicles via the three bus bars just left of center.

The Wayside Interface also communicates with each ride vehicle 10 for monitoring the ride vehicle's status, principally when the ride vehicle is in a zone where it loads and unloads passengers 48. Thus, each rf signal may be digitally addressed to a specific ride vehicle, or in the alternative, infrared communication may be used (instead of rf communication) and communication confined to a small, ride vehicle specific area adjacent to the Wayside Station.

These digital communications are utilized by the Wayside Interface to request and receive ride vehicle diagnostic information, and to select a particular ride program stored among a plurality of such programs in electronic memory 189 aboard each ride vehicle. The diagnostic information requested by the Wayside Interface includes, for example, ride vehicle operating status, mode, ride vehicle subsystem fault indications, computer fault indications, current ride program, longitudinal position with respect to the path length, ride vehicle ID, and time of day.

The front bogie of the ride vehicle mounts two of the position sensors 99 on each side, for a total of four track position proximity-type update sensors. These sensors sense the proximity of path-mounted position markers 473 and 475, each consisting of a number of metal targets 101 mounted within the track, just below the front bogie, as seen in FIG. 9.

In addition to these proximity sensors 99, two idler wheels 103 of the front bogie are used as redundant incremental longitudinal position sensors, in the form of rotary encoders. These encoders, each a quadrature sensor, provide 360-pulse-per-rotation 90-degree phase-shifted output signals, which are coupled to a velocity polarity sensor (which detects forward and reverse velocity) and to high-speed counter inputs 215. These inputs 215 are read and formatted to a total distance measurement, in feet, by the computerized vehicle-control system 40, and are loaded into a distance register. Thus, the ride vehicle 10 keeps track of incremental distance using the idler wheels 103, and uses the update sensors 99 to detect the presence of the path-mounted position markers 473 to detect and correct errors in the tracked position of the ride vehicle. A logic error is ascertained by the computerized vehicle-control system if position errors exceed a relatively small quantity, or if the counter inputs 215 differ by more than a predetermined amount.

Importantly, the idler wheels 103 are utilized instead of a tachometer, which may be subject to error occasioned by slippage and wear of the wheels 14 of the ride vehicle 10. The high speed counter inputs 215 are reset each time that they are read by the CPU 205, and the incremental position measurement is expected to be sufficiently accurate that the position markers 473 may be spaced at great distances, for infrequent detection and update of the incremental position measurements.

Figure 24:
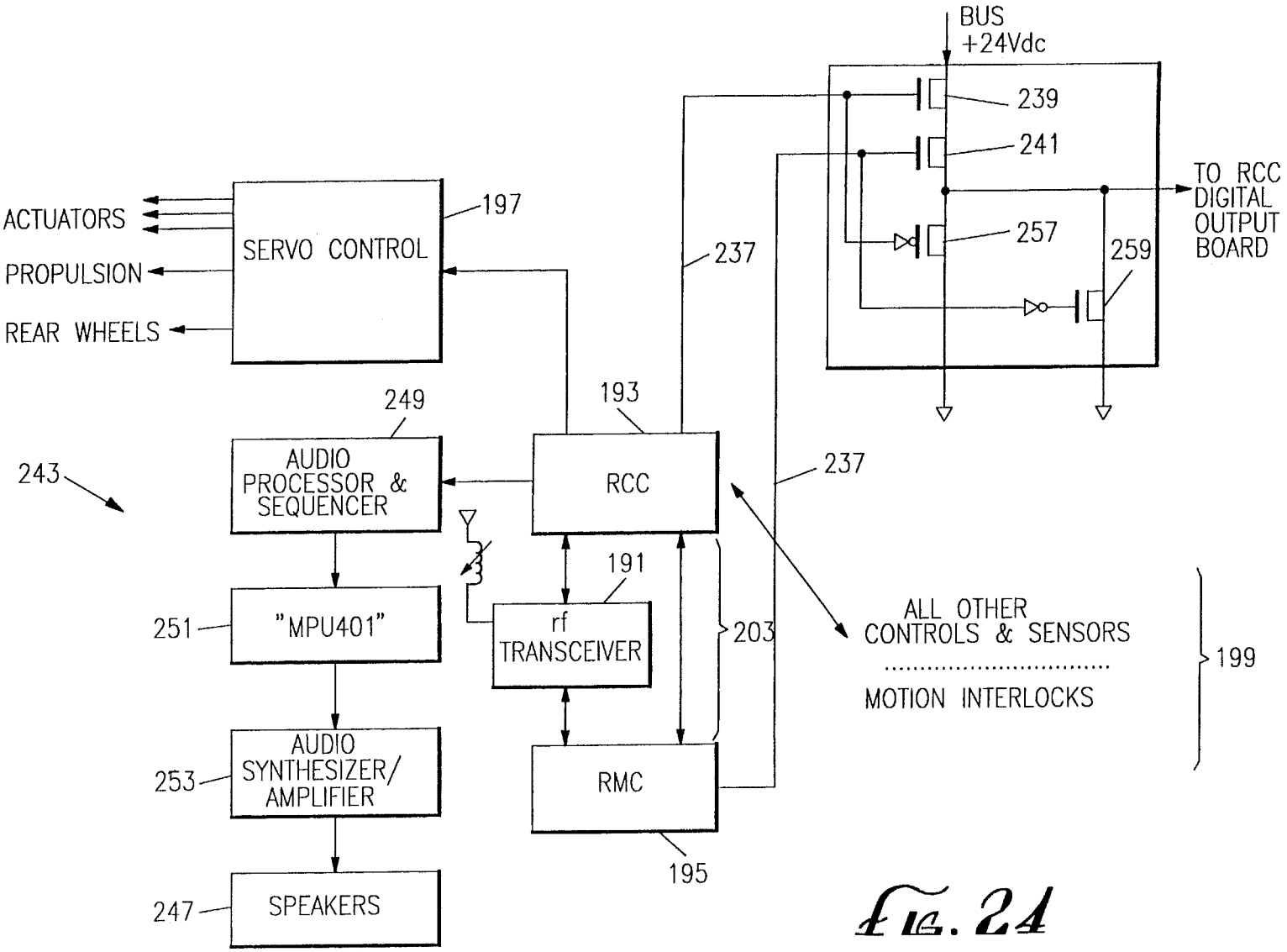
FIG. 24 is another block diagram showing further aspects of the computer control system.

With reference to FIG. 24, the computerized vehicle-control system 40 of a single ride vehicle 10 will be briefly described. All of the ride vehicle's digital functions, including the computerized vehicle-control system 40, are driven by a twenty-four volt direct current (dc) power supply. This power is derived from the 480-volt, three phase ac power supply provided by the power bus 97, discussed above, through the use of step-down transformers aboard each vehicle that provide 480-volt ac primary to 115-volt ac secondary and a twenty-four volt dc power supply. All other vehicle electronics, including a cooling fan, air compressor, and the vehicle's non-digital audio functions, such as amplification, are driven at 115-volts ac.

Each ride vehicle 10 carries an rf transceiver 191 and two on-board computers 193 and 195, which are nearly identical in configuration, and which are utilized in parallel for safety purposes, as part of a "voting" implementation. One computer 193, called the ride control computer ("RCC"), controls the audio aspects of the ride experience and the servo and digital control elements 197 that control propulsion and ride vehicle motion. Both the RCC 193 and its companion ride monitor computer 195 ("RMC") are separately coupled to the rf transceiver 191 and to parallel sensors and bus controls for shut-down of the ride vehicle. The computers 193 and 195 communicate with each other regarding ride vehicle faults, action and status, by the voting scheme, and alert the Wayside Interface if there is a disagreement between the two computers, indicating a logic fault, or an agreement about a serious status that requires ride vehicle shutdown, for example, critical overheating. Depending upon the status, fault or action, both computers 193 and 195 wait a specific time period to receive a related signal from their companion computer before reaching a conclusion as to agreement or disagreement, mostly necessitated due to tolerance differences between different sensors used in parallel by each computer. The system described, by utilizing two computers 193 and 195 in parallel and the mentioned-voting procedure, provides for added reliability and passenger safety.

Figure 23A:
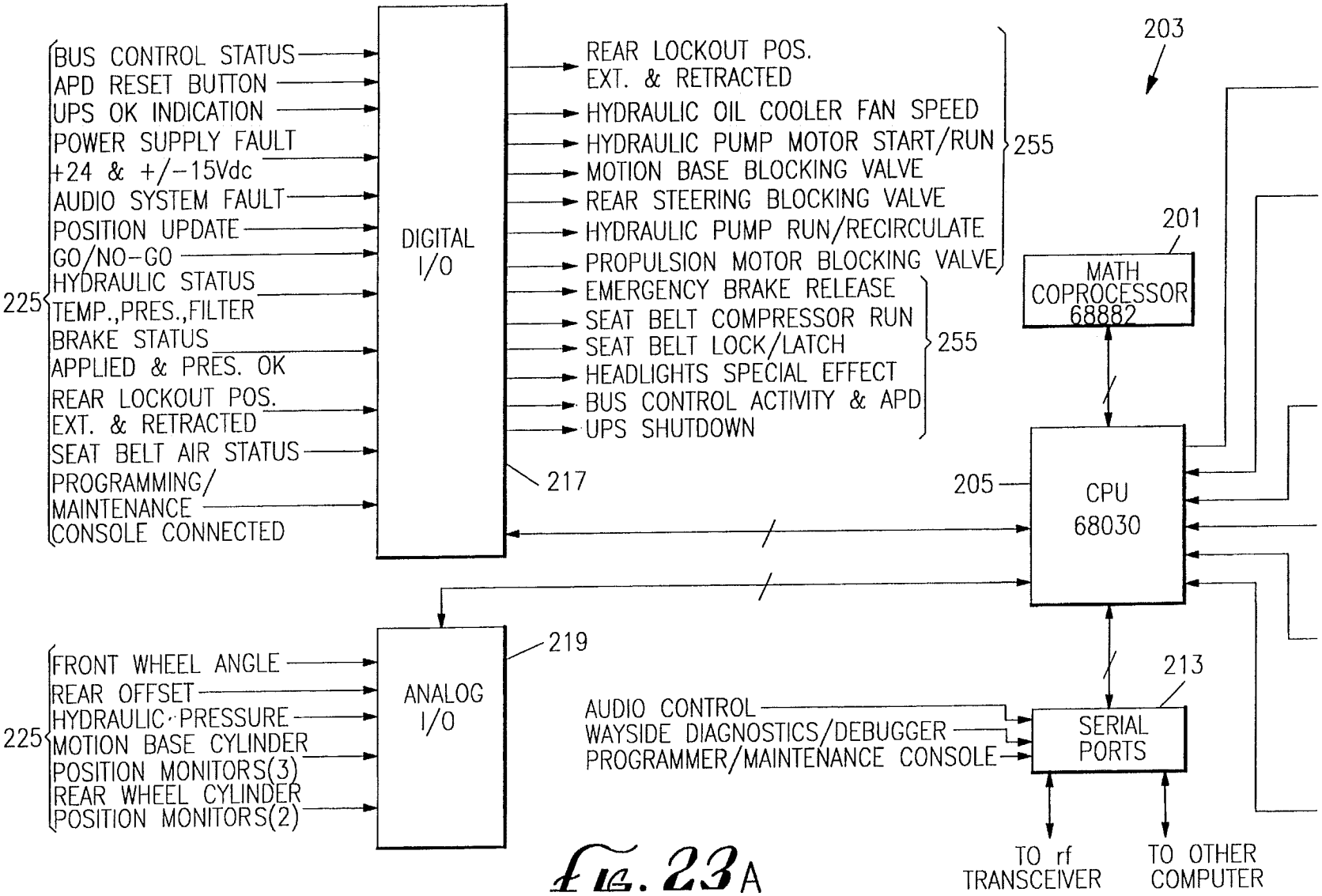
FIG. 23 is a composite drawing consisting of FIGS. 23A and 23B which together form a block diagram showing the architecture and wiring of a computer control system that controls various vehicle functions.
Figures 23, 23B:
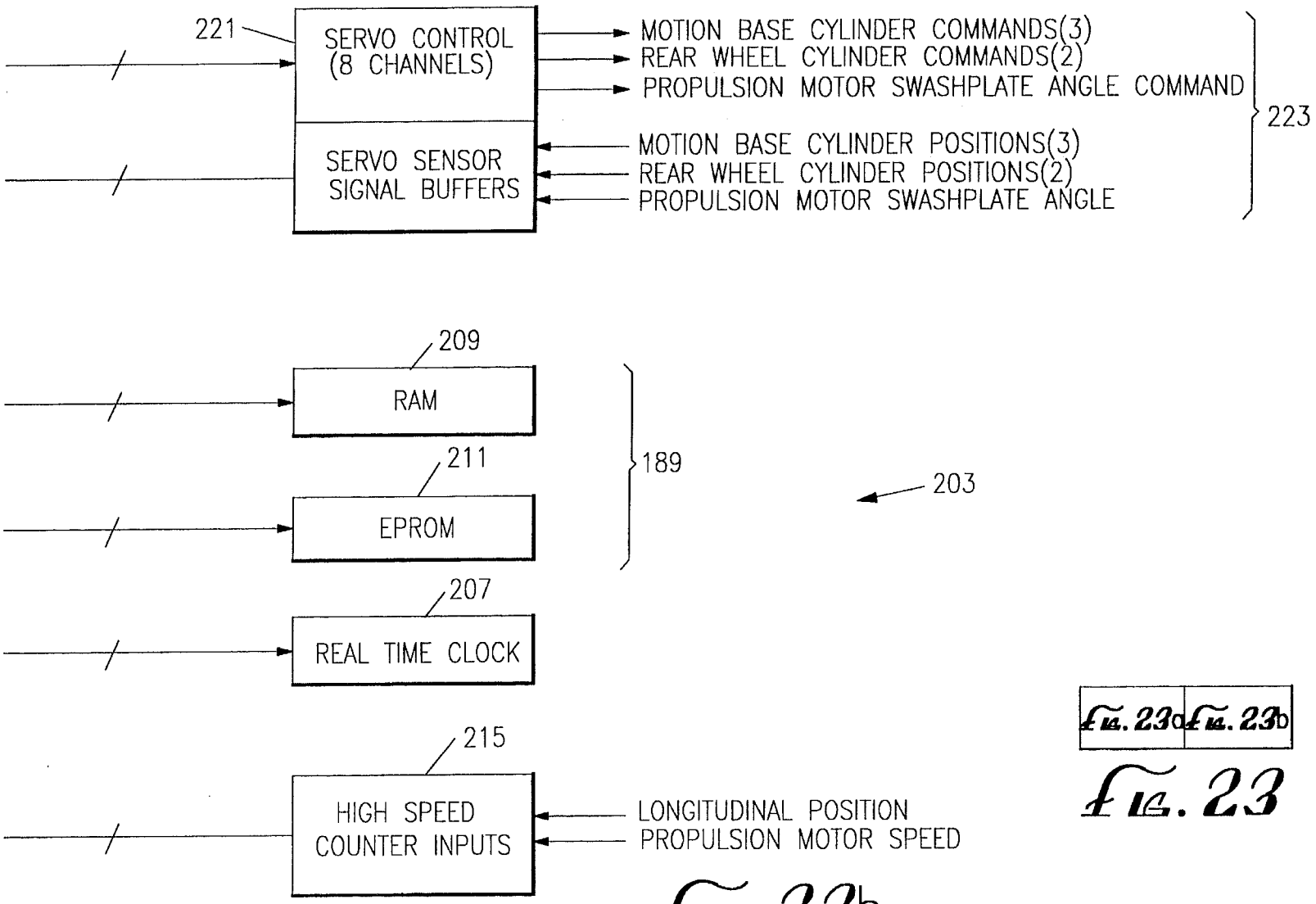

As indicated in FIGS. 23A and 23B, each computer 193 and 195 carries its own memory 189, which contains all the program information necessary to run a plurality of different ride programs. In the preferred embodiment, this memory includes eight megabytes of $E^2$PROM. Each program is stored in a plurality of program portions, each consisting of a plurality of commands which are indexed by time and distance. In this manner, the ride vehicle computers 193 and 195 may independently determine when and where a particular command is to be executed during the ride, and confirm this determination and resultant ride vehicle reaction with the other computer. Each command of each ride program includes a number of digital data values, or commands of each parallel data track, including ride vehicle velocity (including "reverse"), motion base position for each of three axes, offset for the rear of the ride vehicle, audio cues, ride vehicle headlights on and off, and safety functions (including engagement and disengagement of rear follower offset lock-out, lock and release of seat belt tongue and retractor reel, and engagement and disengagement of the motion base actuator block and settling valves). As further discussed below, each ride computer 193 and 195 possesses a math co-processor 201 which is used for all floating point calculations. As indicated above, both the RCC 193 and the RMC 195 are substantially identical in architecture and operate in parallel, and both are generally represented by the reference numeral 203 in FIGS. 23A and 23B.

FIGS. 23A and 23B illustrate the architecture and wiring of one of the computers 203 (RCC and RMC) to the various sensors and controls utilized by the ride vehicle. Each computer has a CPU 205 that includes a Motorola "68030" microprocessor for monitoring ride vehicle sensors and for directing communications, voting, and activities of the servo mechanisms. A real-time clock 207 is utilized for computation of time based segments and overall system control. In addition to random access memory 209, each computer 203 features a modular $E^2$PROM board 211 which generally includes 8 Mbytes of memory for storing eight ride programs which may be accessed. In addition, the math co-processor 201 (having a math specialized co-processor, a Motorola "68882" in the case of the preferred embodiment) is provided for the CPU 205 to all floating point calculations. Each computer 203 also possesses several serial ports 213, as mentioned above, and a set of high-speed counter inputs 215 and digital and analog I/O boards 217 and 219, for monitoring ride vehicle sensors and providing digital control signals. Lastly, servo mechanism control is supplied by a servo control board 221 having eight servo outputs and eight feedback inputs, collectively designated by the reference numeral 223. In the preferred embodiment, only six of these outputs are used, including outputs for each of the three motion base servo actuators 50, 52 and 54, propulsion (swashplate angle of the hydraulic motor 36), and steering for each of the two rear wheels 16 (angular).

The servo control board 221 is installed only in the RCC 193, to drive the servo actuated elements, whereas in an alternative embodiment, each of the RCC 193 and the RMC 195 includes the servo control board 221, which accepts servo feedback signals from the motion base 24, rear steering actuators 126 and the swashplate. However, in the preferred embodiment, all feedback signals from these elements are derived using linear sensors, and the feedback signals fed to the analog I/O board 219 in a zero-to-ten volt format, and are monitored by both of the RCC 193 and the RMC 195 using analog feedback.

Referring again to FIG. 24, the interaction of the two (parallel) computers 193 and 195 and the ride vehicle control functions are diagrammatically presented. As indicated, since the RMC 195 is provided primarily for added safety and backup in the RCC's control of the various mechanical elements of the ride vehicle 10, it would be redundant to require both computers to be electronically coupled to convey identical commands that require a ride vehicle response, i.e., acceleration. Thus, only the RCC 193 is used to control the ride vehicle's servo actuated elements. In the alternative embodiment mentioned above, where each of the RCC 193 and the RMC 195 includes a servo control board 197, control is achieved wiring only the servo control board 197 to the actual servo mechanisms (the three actuators 50, 52 and 54, the swashplate of the HPU 34 and steering actuators 126 for the rear wheels 16), whereas the servo control board of both the RCC and RMC are wired to accept feedback.

Also, in the preferred embodiment, only the RCC 193 provides digital control signal output 255 to control safety features of the ride vehicle, such as motion interlocks 227 and 229 which activate emergency brakes 231 and 233, and block out steering and motion by valve actuation within the hydraulic system. Both computers 193 and 195, however, receive sensor inputs (collectively designated by the reference numeral 225) from the ride vehicle 10, for monitoring ride vehicle status and response, for example, ride vehicle velocity and position of the motion actuators. Both computers are also coupled to the bus controls, collectively 239, 241, 257 and 259, which supply the digital I/O board 217 with power. This construction enables either computer 193 or 195, in the event of a disagreement in the voting that occurs with each directed action or fault analysis, to disable if necessary the ride vehicle's mechanical elements by disabling the bus controls. Both computers 193 and 195, through software, monitor expected position and actual ride vehicle position via position update signals, which are provided from position switches located on the front bogie 90.

Control of the mechanical elements by the computerized vehicle-control system 40, described above, consists of providing a servo actuation signal to hydraulic cylinders for the motion base 24, rear offset (deviation in steering of the rear wheels in relation to the path 18) and vehicle velocity. With respect to the motion base 24, control is achieved by simple use of linear feedback position signals, or servo feedback position signals 223 in the case of the alternative embodiment mentioned above, to ensure that each of the servo actuators 50, 52 and 54 are driven to their commanded position, and by determining whether a fault status exists if the actuators are not so driven. Control over vehicle velocity and rear offset is slightly more complicated, and is discussed below.

1. Control Of Vehicle Velocity

Vehicle velocity, including acceleration and deceleration, is controlled by the hydraulic motor, which as mentioned, is a variable displacement, rotary hydraulic motor. More particularly, the speed of the ride vehicle 10, including dynamic braking, is controlled by varying a swashplate of the hydraulic motor, which directly determines the displacement. The swashplate preferably has an integrated position feedback sensor which provides a propulsion motor swashplate angle analog signal input to the RCC 193.

Speed of the ride vehicle 10 is controlled using two control loops, an inner loop and an outer loop. The inner loop controls the swashplate angle to thereby control motor torque, in aid of providing a commanded amount of acceleration or deceleration. The outer loop, on the other hand, compares actual vehicle velocity with velocity desired by the ride program, and controls the inner loop with this feedback to drive the swashplate angle, such that the provided motor torque and acceleration or deceleration provided yields exactly the desired vehicle velocity.

2. Control Of Vehicle Steering

The maximum rear offset and rear steering are controlled by a linear hydraulic cylinder (including a servo valve driven by a proportional-derivative servo control), and a position feedback sensor, while front wheel steering, as mentioned above, is controlled by a mechanical mechanism that is linked to the bogie. While the preferred embodiment uses the aforementioned bogie configuration, with front wheel steering being controlled by the path 18, a contemplated alternative embodiment utilizes front wheel steering independent of the path, with permitted lateral displacement from the bogie. Thus, in this alternative embodiment, front and rear wheels may be separately driven within the envelope, and an additional servo output from the servo control board 221 utilized to control front offset.

The linear hydraulic cylinders used for steering control directs the wheel angle of each wheel of the rear steering system. As with the velocity control, mentioned above, a similar two loop control system is provided to respectively apply (1) feedback to correct for steering errors, and (2) use of the rear steering offset value to calculate the required angle of each rear wheel, based upon desired rear offset and the direction of the path 18 and front wheel steering, and to convert the calculated steering angle to a required stroke for each of the linear actuators, based upon the steering linkage geometry.

3. Use Of Ride Programs

Each mechanical element, for example, rear steering actuators, vehicle velocity (swashplate), and each of the three servo actuators 50, 52 and 54 of the motion base, has a parallel data track dedicated to control of that actuator during the ride program. In other words, each parallel data track includes a sequence of data that describes the movements of the corresponding actuator for the duration of the ride program. This duration is, in the preferred embodiment, measured by the position of the ride vehicle 10 in feet along the path 18, and extends to a full loop of the path. Thus, as the ride vehicle 10 moves forward, the computers 193 and 195 obtain instructions from the selected ride program which defines increase or decrease in velocity, change in rear offset, and new articulation of the passenger holding structure 20. The parallel data tracks also include tracks that correspond to audio cues, vehicle headlights (on/off) and safety functions, which include follower rear offset lock-out, seat belt disengagement, and motion base actuator block and settling valve actuation. In addition, each ride program includes identifying information, including name, date of creation, remarks, but most importantly, an error detection code that permits each of the RCC 193 and RMC 195 to identify data errors to ensure proper performance of the selected ride program.

Time-based sequences may also be used, either in lieu of, or in combination with, the vehicle position. In fact, each ride vehicle includes hold-patterns which are designed to entertain and amuse the passengers 48 during a ride stoppage. That is, if the ride vehicle 10 is stopped, the motion base 24 or other mechanical element may be actuated in a predefined, timed pattern, pending renewed motion of the vehicle in accordance with the ride program. In addition, however, time-based sequences are also preferably used at intermittent locations around the path 18, for example, to create a "stuck-in-the-mud" or other similar sequence, or to simulate the effect of a rock slide.

Power-Up And Operation Of The Vehicle

In addition to the plurality of ride programs, which are stored in the $E^2$PROM 211 for each of the two computers 193 and 195, each computer has memory that contains the initialization, ride execution and monitoring software which is used to govern execution of the sequences of data that correspond to each ride program and the implementation of ride vehicle or motion base shutdown, if required.

Initialization is performed anytime the ride vehicle 10 is stopped by a loss of electrical power or due to an emergency condition. The power-up steps of each ride vehicle 10 perform the tasks of zeroing each of the actuators, to ensure that no vehicle motion or actuation of the motion base 24 is triggered upon power-up, and charging the high-pressure accumulator 157 to have sufficient hydraulic pressure to drive all actions of the motion base and vehicle. A hydraulic pressure sensor signal 225 is used by each computer to ascertain when hydraulic pressure is approximately 3500 lbs. per square inch, and within a range, to regulate pressure supplied by the hydraulic power unit 34. Once the minimum hydraulic pressure has been reached, each of the vehicle's actuators may then be actuated in accordance with the ride program and the vehicle advanced along the path 18.

During initialization, the computerized vehicle-control system 40 first disables the motion base 24, and the servo actuators 126 that control steering are driven to correspond to no lateral offset. As soon thereafter as the go signal is raised by the Wayside Interface, the ride vehicle 10 is advanced at minimum velocity along the path 18 until the next position marker is detected by the vehicle. The default ride program is then automatically selected to govern ride vehicle actions, and the vehicle is moved with its motion base 24 inactive towards the hold area, until it can no longer proceed due to the lowering of the go signal, indicating that the vehicle is in a queue for the hold area.

Once the passengers 48 have been safely loaded aboard the ride vehicle 10 and a particular or default ride program selected to govern vehicle operation, the ride vehicle is cleared to leave the Wayside Station and begin execution of the ride program. The ride execution software of the RCC 193 commences ride program operation by selecting initial data from the sequence of data of the selected one of the plurality of ride programs. As a practical matter, the initial data will set ride vehicle velocity as part of a sequence of vehicle motion data to move the ride vehicle 10 away from the Wayside Station. As the ride vehicle 10 moves in position along the path 18, additional data is retrieved from the $E^2$PROM 211 in parallel data tracks, to define the state of each of the mechanical elements that combine to create the ride experience, at any given moment. As indicated above, this data will include vehicle velocity, rear offset, and motion base actuation data.

Accordingly, the ride vehicle 10 is first called upon to leave the Wayside Station and begin its movement along the path 18. The computers 193 and 195 aboard the ride vehicle 10 utilize their distance registers and high-speed counters 215 to maintain an accurate indication of the vehicle's position along the path 18 as measured in feet, time of day, and also an elapsed time since commencement of the program. In this sense, the high-speed counters 215 are incremented 360 times with each rotation of the wheels, and computer software is relied upon to derive a specific foot position around the path 18. Notably, each of the RCC 193 and RMC 195 receives two signals, one from each rotary encoder, which may produce different numbers of pulses as the ride vehicle enters a turn. Thus, the software of the computerized vehiclecontrol system 40 simply takes an average of the two numbers (tracked with the high-speed counters 215), producing an error if their difference is too disparate. One of distance from the Wayside Station and the elapsed time from commencement of the ride program, or a combination of both, is used by software in the preferred embodiment to index the selected ride program and to actuate the plurality of mechanical elements aboard each ride vehicle 10 as it follows the path 18. With each increment in position, either distance in terms of feet or elapsed time, the $E^2$PROM is checked for subsequent data in the sequence of data that it contains. Accordingly, the computers 193 and 195 are continuously retrieving data from the sequence of data that define instantaneous vehicle actions in accordance with the selected ride program.

As mentioned above, the rotary position encoders are not only the mechanism that the ride vehicle 10 has for determining its position along the path 18. In addition, position markers positioned at various points along the path are defined in program memory to be associated with specific foot positions along the path. Accordingly, each time the ride vehicle 18 reaches one of the various position markers located around the path 18, the distance registers are checked to ensure that they reflect actual position of the ride vehicle 10 and the rotary encoders are used to supply incremental distance beyond the previous position marker.

The ride execution and monitoring software calls for each of the RCC 193 and the RMC 195 to monitor vehicle activities in accordance with the instructions of the parallel data tracks of the selected ride program, and to utilize the aforementioned voting procedure to agree or disagree as to status, indicating (1) proper operation, or an agreed fault condition, or (2) a logic fault. In addition to its other activities, the ride execution and monitoring software is also called upon to perform certain safety functions, including a power disconnect and motion base shutdown if it is determined that specified errors, including logic errors, exist.

1. Vehicle Power Disconnect

As mentioned earlier, the computerized vehicle-control system 40 exercises control over vehicle power using a number of switches 239, 241, 257 and 259 of the bus controls. The software of the ride vehicle 10 monitors vehicle activity and initiates a power disconnect, informing the Wayside Interface of the same, for any of the following reasons:

a. Failure to respond to the power bus controls, or a logic fault.

b. Hydraulic fluid level low, shutdown.

c. Loss of steering position sensor signal.

d. Excess lateral position (offset) error.

e. Excess longitudinal position error.

f. Hydraulic fluid over-temperature, shutdown.

g. Return accumulator pressure too low.

h. Seat belt lock air pressure too low.

i. Excessive vehicle speed.

j. Rear offset lock-out state error.

k. Loss of longitudinal position sensor signal.

The power disconnect function remains in effect until the condition causing the disconnect has been corrected and service personnel activate a reset key switch on the ride vehicle 10, or initiate a reset using the special programming console, which may be connected to the vehicle for maintenance and diagnostics. If the problem cannot be corrected, then service personnel use the programming console in the drive mode, to drive the ride vehicle 10 along the path 18 and into the maintenance area.

2. Disablement Of The Motion Base 24

As also mentioned above, the software of the ride vehicle 10 is also called upon to disable the motion base 24 and bleed pressure from the motion base actuators 50, 52 and 54. However, certain errors, such as positional errors which may signify that the ride vehicle 10 is inappropriately positioned with respect to moving show sets, may also require a deactivation of the motion base 24 for reasons of passenger safety. A motion base stop command is utilized in the preferred embodiment when there is (a) a loss of signal from a servo actuator position sensor, (b) excessive motion base servo actuator stroke, as determined from the corresponding sensor feedback signal, or (c) unacceptable position error, which requires shutdown if there is a question concerning clearance of the motion base 24.

When the vehicle motion base stop command is activated, the vehicle software de-energizes the motion base 24 by controlling the blocking valves 182, 184 and 186 to close, and by opening the settling valves, thereby stopping all servo actuator movement and causing the motion base to settle to the home or fully down position, with no further movement. In addition, the software commands the use of the current ride program parallel data track values for steering and rear offset lock-outs, audio, vehicle headlights on/off, hydraulic and safety functions, and other functions not relating or affecting the motion base control, to direct the ride vehicle 10 to return to the Wayside Station. Once the ride vehicle 10 has been returned to the Wayside Station, the motion base 24 may either be reset, allowing for renewed activity, or the ride vehicle may be removed to the maintenance area, or otherwise taken off-line, for diagnostics.

From the foregoing, it will be appreciated that the preferred ride vehicle 10 provides several distinct motion patterns that may be executed in various sequences in an amusement attraction, along with appropriate scenery, audio sounds and various other special effects, to create a very unique ride experience for the passengers in the ride vehicle. The ride vehicle 10 is capable of enhancing the sensation of ride vehicle movement that is actually taking place, as well as providing the passengers 48 with realistic moving ride vehicle experiences that are not actually happening.

The invention defined in the claims which follow may be implemented in many different ways. Another example, quite similar to the preferred implementation, discussed above, would be to implement the ride vehicle 10 as a raft that apparently travels down a set of rapids. Motion of the ride vehicle 10 can be quite precisely controlled along a path, with motion (seemingly created by water currents and obstacles) imparted by the motion base 24.

Having thus described several exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

We claim:

1. A ride vehicle control system mounted within a ride vehicle of an amusement attraction, wherein the ride vehicle moves along a path within the amusement attraction, said control system comprising:

a hydraulic power unit having a source of hydraulic fluid that produces hydraulic energy therefrom;

an accumulator charged with hydraulic energy produced by said hydraulic power unit;

a hydraulically-operated actuator having the form of one of an actuator which causes complete propulsion of the vehicle along the path using the hydraulic energy, an actuator that articulates passengers of the vehicle with respect to a chassis of the vehicle, as the vehicle moves along the path, and an actuator that controls variable steering of the vehicle steering, as the vehicle moves along the path; and a regulator that regulates the flow of hydraulic energy from said accumulator to the hydraulically-operated actuator.

2. A ride vehicle control system according to claim 1, wherein ride vehicle has a source of electric power, and wherein:

said hydraulic power unit includes a pump that is driven by the electric power and that is coupled to said source to pump said hydraulic fluid to thereby create hydraulic energy; and said accumulator is charged with hydraulic energy produced by said pump.

3. A ride vehicle control system according to claim 2, further comprising:

a reservoir distinct from the accumulator and coupled to said pump, said pump coupled between said reservoir and said accumulator to pump hydraulic fluid from said reservoir toward said accumulator to thereby charge said accumulator with hydraulic energy;

a blocking valve that controls the flow of hydraulic energy to the hydraulically-operated actuator and that may be selectively actuated to block any flow of hydraulic energy to the hydraulically-operated actuator; and a settling valve that is selectively actuated to control the release of hydraulic fluid from the hydraulically-operated actuator.

4. A ride vehicle control system according to claim 2, wherein the hydraulically-operated actuator is a steering actuator coupled to said regulator to receive hydraulic energy from said regulator and wherein said steering actuator steers the ride vehicle.

5. A ride vehicle control system according to claim 4, wherein:

the ride vehicle includes a second hydraulically-operated actuator which is a hydraulically-operated motor that receives an electronic signal indicative of a selected vehicle propulsion, and in response thereto, causes vehicle propulsion as a prime mover of the vehicle, and;

the hydraulically-operated motor is operatively coupled between a high pressure side of said motor, between said motor and said accumulator and a low pressure side of the hydraulically-operated motor.

6. A ride vehicle control system according to claim 2, wherein the ride vehicle includes an electronic control system that controls the operation of the hydraulically-operated actuator in accordance with a ride program that defines the operation of the hydraulically-operated actuator at different positions of the ride vehicle, position defined by at least one of elapsed time, distance travelled along the path, and recognition of a condition by a sensor mounted by the ride vehicle and coupled to the electronic control system, and wherein the hydraulically-operated actuator may be operated within a variable range of actuation, said ride vehicle control system further comprising:

an electronic control of the hydraulically-operated actuator that controls the extent of actuation of the hydraulically-operated actuator within the variable range of actuation, said electronic control coupled to and controlled by the electronic control system in accordance with the ride program.

7. A ride vehicle control system according to claim 6, wherein said electronic control includes a feedback sensor that is coupled to the electronic control system and that provides an electronic signal thereto representative of the extent of actuation to thereby enable feedback control of the hydraulically-operated actuator.

8. A ride vehicle control system according to claim 7, wherein the electronic control system includes a computer that runs software, said electronic signal being digitally sampled and analyzed by the software, and said electronic control being effectuated by the software to control the extent of actuation of the hydraulically-operated actuator, and wherein said feedback control is also effected in software by altering the control of the extent of actuation in response to said electronic signal.

9. A ride vehicle control system according to claim 2, wherein the ride vehicle includes a motion base and a passenger holding structure that is articulated by the motion base, and wherein the hydraulically-operated actuator includes a motion base actuator that assists in articulation of the motion base, the motion base actuator coupled to said regulator to receive hydraulic energy therefrom.

10. A ride vehicle control system according to claim 9, wherein the ride vehicle includes a plurality of hydraulically-operated actuators, and wherein:

said regulator regulates the flow of hydraulic energy from said accumulator to each one of the plurality of hydraulically-operated actuators.

11. A ride vehicle control system according to claim 10, wherein the plurality of hydraulically-operated actuators also include a hydraulic motor coupled to said manifold to receive hydraulic energy from said manifold and wherein the hydraulic motor propels the ride vehicle.

12. A ride vehicle control system according to claim 10, wherein said regulator is a manifold, and wherein the plurality of hydraulically-operated actuators also include a hydraulically-operated motor coupled to said manifold to receive hydraulic energy from said manifold and wherein said motor drives the ride vehicle.

13. A ride vehicle control system according to claim 10, wherein the plurality of hydraulically-operated actuators includes at least three hydraulically-operated actuators which actuate a motion base and are coupled to said regulator to receive hydraulic energy therefrom.

14. A ride vehicle control system according to claim 10, wherein:

the plurality of hydraulically-operated actuators include at least three motion base actuators coupled to the manifold, to receive hydraulic energy from it, the at least three motion base actuators collectively articulating the motion base in a plurality of degrees of freedom; and the system uses regenerative braking to assist charging the accumulator with hydraulic fluid.

15. A ride vehicle control system according to claim 2, wherein the path carries a source of electric power continuously along its length, said ride vehicle control system further comprising an electrical pickup that taps electric power from the source of electric power as the ride vehicle follows the path, said electrical pickup coupled to said hydraulic power unit so as to supply said pump with the electric power to thereby drive said pump.

16. A ride vehicle control system according to claim 15, wherein the source of electric power is a bus bar that follows the path, and wherein said electrical pickup is a follower device that follows the bus bar and is maintained in continuous contact therewith.

17. A ride vehicle control system according to claim 1, wherein the ride vehicle includes a motion base and a passenger holding structure that is articulated by the motion base, and wherein the hydraulically-operated actuator includes a motion base actuator that assists in articulation of the motion base, the motion base actuator coupled to said regulator to receive hydraulic energy therefrom.

18. A ride vehicle control system according to claim 17, wherein the ride vehicle includes a plurality of hydraulically-operated actuators, and wherein:

said regulator is a manifold that regulates the flow of hydraulic energy from said accumulator to the plurality of hydraulically-operated actuators.

19. A ride vehicle control system according to claim 18, wherein the plurality of hydraulically-operated actuators includes an actuator which is a hydraulically-operated motor coupled to said manifold to receive hydraulic energy from said manifold, and wherein said hydraulically-operated motor drives the ride vehicle.

20. A ride vehicle control system according to claim 18, wherein the plurality of hydraulically-operated actuators also include a steering actuator coupled to said manifold to receive hydraulic energy from said manifold and wherein said steering actuator steers the ride vehicle.

21. A ride vehicle control system according to claim 18, wherein the plurality of hydraulically-operated actuators also include at least three motion base actuators coupled to said manifold to receive hydraulic energy therefrom.

22. A ride vehicle control system according to claim 1, wherein the hydraulically-operated actuator is a hydraulically-operated motor, wherein said regulator is a manifold that is coupled to said hydraulically-operated motor to supply hydraulic energy thereto, and wherein said hydraulically-operated motor propels the ride vehicle as a prime mover of the vehicle.

23. A ride vehicle control system according to claim 22, wherein:

said accumulator is a high-pressure accumulator;

said ride vehicle control system further comprises a second, low-pressure accumulator, said hydraulic motor coupled between said high-pressure accumulator and said low-pressure accumulator and driven by hydraulic fluid from said high-pressure accumulator to provide propulsion to the ride vehicle; and an angle of said hydraulic motor is reduced to brake the ride vehicle and to control said hydraulic motor during braking to pump hydraulic fluid from said low-pressure accumulator toward said high-pressure accumulator to thereby provide regenerative braking.

24. A ride vehicle control system according to claim 22, wherein said hydraulically-operated motor includes an electro-hydraulic servo valve that receives an electronic control signal indicative of speed of the ride vehicle, said electro-hydraulic servo valve operatively coupling said motor and said hydraulic power unit and regulating the angle of said motor to thereby control speed of the ride vehicle.

25. A ride vehicle control system according to claim 1, wherein the hydraulically-operated actuator is a steering actuator coupled to said regulator to receive hydraulic energy from said regulator and wherein said steering actuator steers the ride vehicle.

26. A ride vehicle control system according to claim 1, further comprising a regenerative braking system operatively coupled to said accumulator to generate hydraulic energy upon deceleration of the ride vehicle.

27. A ride vehicle control system according to claim 1, further comprising:

a reservoir distinct from said accumulator;

an outlet of the hydraulically-operated actuator that permits the release of hydraulic fluid from the hydraulically-operated actuator; and a return line coupling said outlet and said reservoir that returns released hydraulic fluid thereto;

wherein said hydraulic power unit is coupled between said reservoir and said accumulator to thereby charge said accumulator with hydraulic energy.

28. A ride vehicle control system according to claim 1, further comprising:

a reservoir distinct from the accumulator and coupled to said hydraulic power unit, said pump coupled between said reservoir and said accumulator to thereby charge said accumulator with hydraulic energy;

a blocking valve that controls the flow of hydraulic energy to the hydraulically-operated actuator and that may be selectively actuated to block any flow of hydraulic energy to the hydraulically-operated actuator; and a settling valve that is selectively actuated to control the release of hydraulic fluid from the hydraulically-operated actuator.

29. A ride vehicle control system according to claim 28, wherein the ride vehicle includes a motion base and a passenger holding structure that is articulated by the motion base, wherein the hydraulically-operated actuator includes a motion base actuator that assists in articulation of the motion base, and wherein:

the motion base actuator is coupled to said regulator to receive hydraulic energy therefrom; and said settling valve is selectively actuated to release hydraulic fluid from the motion base actuator to thereby permit the motion base to settle under the force of gravity.

30. A ride vehicle control system aboard each one of a plurality of ride vehicles in an amusement attraction, each ride vehicle following a track having a power bus, each ride vehicle tapping the power bus to obtain vehicle power, said ride vehicle control system comprising:

a source of hydraulic fluid aboard each vehicle;

an electric pump aboard each vehicle that pumps, powered by electricity derived from the power bus, hydraulic fluid from the source to thereby provide pressurized hydraulic fluid; and a hydraulically-operated actuator aboard each vehicle in the amusement attraction, said hydraulically-operated actuator operatively coupled to said pump and having first and second fluid chambers and being movable from a first position to a second position by supply of pressurized hydraulic fluid to said first fluid chamber and release of hydraulic energy from said second fluid chamber, and movable from said second position toward said first position by supply of pressurized hydraulic fluid to said second fluid chamber and release of hydraulic energy from said first fluid chamber.

31. A ride vehicle control system according to claim 30, further comprising a servo valve that receives said pressurized hydraulic fluid and is selectively controlled to provide hydraulic energy obtained therefrom to one of said first and second fluid chambers to actuate said hydraulically-operated actuator.

32. A ride vehicle control system according to claim 30, wherein the ride vehicle includes a motion base and a passenger holding structure that is articulated by the motion base, and wherein:

said ride vehicle control system further includes a set of motion base actuators that articulate the motion base, the set of motion base actuators coupled to a manifold to receive hydraulic energy therefrom, an accumulator coupled to said pump to receive hydraulic energy from said pump and store the same, and said manifold is connected between said accumulator and said actuators to gate the release of hydraulic energy from said accumulator to said actuators;

each of said motion base actuators is a hydraulically-operated actuator operatively coupled to said pump through said manifold, has first and second fluid chambers, is movable from a first position to a second position by supply of pressurized hydraulic fluid to said first fluid chamber and by release of hydraulic energy from said second fluid chamber, and is movable from said second position toward said first position by supply of pressurized hydraulic fluid to said second fluid chamber and release of hydraulic energy from said first fluid chamber.

33. A ride vehicle control system according to claim 30, further comprising a hydraulically-operated motor, mounted in each vehicle, that powers the vehicle in response to a supply of pressurized hydraulic fluid, said motor operatively coupled to said pump to thereby receive pressurized hydraulic fluid, and having a speed control valve that gates the displacement of pressurized hydraulic fluid toward said motor to operate the same, and that thereby controls the speed of said ride vehicle.

34. A ride vehicle control system according to claim 33, wherein:

said ride vehicle control system also includes a high-pressure accumulator and a low-pressure accumulator;

said high-pressure accumulator is coupled to said pump to receive pressurized hydraulic fluid and thereby store generated hydraulic energy;

said motor is coupled between said high-pressure accumulator and said low-pressure accumulator, and wherein said speed control valve is selectively operated to permit pressurized hydraulic fluid to flow from said high-pressure accumulator toward said low-pressure accumulator through said motor to thereby propel said motor;

said speed control valve is selectively operated to brake motion of the ride vehicle, to thereby cause the vehicle's motion to mechanically operate said motor to pump hydraulic fluid from said low-pressure accumulator toward said high-pressure accumulator to thereby provide regenerative braking, which decelerates the ride vehicle while increasing the hydraulic energy stored in said high-pressure accumulator.

35. A ride vehicle control system, which provides impetus to move the vehicle along a path, said ride vehicle control system comprising:

a high-pressure accumulator that stores hydraulic energy in the form of pressurized hydraulic fluid;

a hydraulically-operated motor coupled to said high-pressure accumulator to receive hydraulic energy therefrom, said pressurized hydraulic fluid displacing said motor according to a variable motor angle;

a low-pressure accumulator that receives hydraulic fluid that has previously displaced said motor, and is of a lower pressure than said pressurized hydraulic fluid; and a control that controls said variable motor angle to thereby vary the torque output by said motor;

wherein said control may be varied to permit said pressurized hydraulic fluid to flow from said high-pressure accumulator through said motor to said low-pressure accumulator, to thereby drive said motor, and wherein said control may be varied when the ride vehicle is in motion to permit motion of the vehicle to cause said motor to pump hydraulic fluid in the reverse direction, from said low-pressure accumulator toward said high-pressure accumulator to thereby charge the same with hydraulic energy while braking the ride vehicle.

36. A ride vehicle control system according to claim 35, further comprising a blocking valve coupled between said high-pressure accumulator and said hydraulic motor and selectively movable between a first position, wherein hydraulic fluid may be pumped into said high-pressure accumulator when said hydraulic fluid is pumped in the reverse direction, and a second position, wherein said blocking valve blocks the pumping of hydraulic fluid into said high-pressure accumulator to increase the resistance to pumping in the reverse direction and thereby provide heightened dynamic braking torque.

37. A ride vehicle control system mounted within a ride vehicle of an amusement attraction, comprising:

a variable displacement hydraulically-operated motor that converts energy between hydraulic energy and kinetic energy;

a control that controls a displacement of said motor;

a hydraulic power unit having a source of hydraulic fluid that produces hydraulic energy therefrom;

an accumulator charged with hydraulic energy produced by said hydraulic power unit; and a blocking valve that operatively couples said accumulator with said motor;

wherein said blocking valve is moved between an open state, wherein it permits said control to generate positive displacement of said motor, such that hydraulic energy is converted to kinetic energy that propels the vehicle, and negative displacement, such that the vehicle is decelerated and thereby converts kinetic energy of the vehicle to hydraulic energy which charges said accumulator with hydraulic energy, and a closed state, wherein resistance to charging said accumulator by negative displacement of said motor is increased relative to said open state, thereby providing increased braking power.

* * * * *